US007210182B2

(12) United States Patent
Fyvie et al.

(10) Patent No.: US 7,210,182 B2
(45) Date of Patent: May 1, 2007

(54) SYSTEM AND METHOD FOR SOLVENT RECOVERY AND PURIFICATION IN A LOW WATER OR WATERLESS WASH

(75) Inventors: Thomas Joseph Fyvie, Schenectady, NY (US); Darren Lee Hallman, Clifton Park, NY (US); Teresa Grocela Rocha, Waterford, NY (US); Philip Alexander Shoemaker, Scotia, NY (US)

(73) Assignee: General Electric Company, Niskayuna, NY (US)

( * ) Notice: Subject to any disclaimer, the term of this patent is extended or adjusted under 35 U.S.C. 154(b) by 557 days.

(21) Appl. No.: 10/330,734

(22) Filed: Dec. 30, 2002

(65) Prior Publication Data

US 2003/0196282 A1 Oct. 23, 2003

Related U.S. Application Data

(63) Continuation-in-part of application No. 10/127,001, filed on Apr. 22, 2002.

(51) Int. Cl.
*D06B 5/10* (2006.01)

(52) U.S. Cl. ..... 8/158; 8/159; 68/18 F; 68/18 R; 68/18 D

(58) Field of Classification Search ..... 134/105, 134/108; 68/18 F, 18 C, 18 R; 8/158, 159, 8/18 D See application file for complete search history.

(56) References Cited

U.S. PATENT DOCUMENTS 2,828,862 A * 4/1958 Johnson ..... 210/772
3,203,208 A * 8/1965 Brucken ..... 68/207
3,327,856 A * 6/1967 Beduhn ..... 210/136
3,386,796 A * 6/1968 Videen ..... 8/142
3,421,835 A * 1/1969 McCarty ..... 8/158

(Continued)

FOREIGN PATENT DOCUMENTS

EP 0 543 665 A1 5/1993

(Continued)

OTHER PUBLICATIONS

"*Dahl Fuel Filter Water Separator*," Pecuniary, Inc. (www.diesel-fuels.com), 10 pages.

(Continued)

*Primary Examiner*—Frankie L. Stinson
(74) *Attorney, Agent, or Firm*—Jason K. Klindtworth; Jean K. Testa

(57) ABSTRACT

Method and apparatus for recovering and purifying a solvent used in an article cleaning appliance are provided. The method allows passing solvent-based cleaning fluid from a wash basket through a coarse filter configured to remove relatively large particulates from the cleaning fluid. The method further allows passing cleaning fluid from the coarse filter through a particulate filter configured to remove relatively fine particulates from the cleaning fluid. An aqueous phase that may be present in the cleaning fluid is separated by decanting and coalescing through a separator/filter assembly. The cleaning fluid may then be passed through a regeneration cartridge for removing any water that may remain in the cleaning fluid, and for adsorbing organic contaminants that may be present in the cleaning fluid. Recovered solvent may be stored in a tank for subsequent use in a cleaning process performed by the appliance.

16 Claims, 18 Drawing Sheets

U.S. PATENT DOCUMENTS 3,497,452 A * 2/1970 Arvanitakis ..... 210/663
3,583,567 A 6/1971 Maestrelli
3,728,074 A * 4/1973 Victor ..... 8/142
3,931,011 A 1/1976 Richards et al.
3,966,602 A * 6/1976 Burger ..... 210/746
4,138,337 A 2/1979 Smith
D253,422 S 11/1979 Smith
4,279,704 A 7/1981 Noble, Sr. et al.
4,283,279 A 8/1981 Smith
4,288,329 A * 9/1981 Duval ..... 210/772
4,298,465 A 11/1981 Druffel
4,444,625 A 4/1984 Smith
4,456,529 A 6/1984 Shinaver
4,513,590 A * 4/1985 Fine ..... 68/18 C
4,661,612 A 4/1987 George et al.
4,774,346 A 9/1988 Imai et al.
5,047,123 A * 9/1991 Arvanitakis ..... 202/170
5,069,755 A * 12/1991 Durr et al. ..... 202/169
5,219,371 A * 6/1993 Shim et al. ..... 8/149.1
5,225,509 A 7/1993 Heinrich et al.
5,236,580 A 8/1993 Kelleher
5,238,899 A 8/1993 Kadowaki et al.
5,245,067 A 9/1993 Schneider et al.
5,288,831 A 2/1994 Ichinohe et al.
5,348,588 A * 9/1994 Winston ..... 134/10
5,520,028 A * 5/1996 Kim et al. ..... 68/18 F
5,783,078 A 7/1998 Roll et al.
5,860,796 A 1/1999 Clausen
5,948,441 A * 9/1999 Lenk et al. ..... 424/489
5,997,739 A 12/1999 Clausen et al.
6,042,617 A 3/2000 Berndt
6,042,618 A 3/2000 Berndt et al.
6,056,789 A 5/2000 Berndt et al.
6,059,845 A * 5/2000 Berndt et al. ..... 8/142
6,063,135 A 5/2000 Berndt et al.
6,086,635 A 7/2000 Berndt et al.
6,203,698 B1 3/2001 Goodrich
7,000,437 B2 * 2/2006 Raney et al. ..... 68/18 F

FOREIGN PATENT DOCUMENTS

JP 11-57328 * 3/1999

OTHER PUBLICATIONS

"*Turbine Series Fuel Filter/Water Separators*," Mid-Atlantic Engine Supply Corp. (www.maesco.com), 11 pages.

* cited by examiner

SYSTEM AND METHOD FOR SOLVENT RECOVERY AND PURIFICATION IN A LOW WATER OR WATERLESS WASH

This application is a continuation-in-part of co-pending and commonly assigned U.S. patent application Ser. No. 10/127,001 filed Apr. 22, 2002.

BACKGROUND OF INVENTION

Conventional household clothing washers use anywhere from about 60 liters to about 190 liters of water to wash a typical load of clothing articles. The spent water and cleaning agents are then dumped into sewage. Furthermore, the water is frequently heated to improve wash effectiveness and usually requires a large amount of energy to be put into the articles as heat in order to vaporize the retained water and dry the articles. The combination of high water usage, high-energy usage and disposal of cleaning additives in the detergent can put a large strain on the environment.

Conventional perchloroethylene (PERC) professional dry cleaning solvent has been shown to be hazardous to human health as well as to the environment. Use of a cyclic siloxane composition as a replacement for PERC is described in Kasprzak, U.S. Pat. No. 4,685,930 and Dullien et al., U.S. Pat. No. 6,063,135. The use of a siloxane solvent in laundering has been shown to result in reduced wrinkling, superior article care, and better finish than water washing. Furthermore, the siloxane solvent has a lower heat of vaporization than water. Compared to water, the siloxane solvent can be more easily dried out of the article. If a washing machine contained a solvent based cleaning cycle, the solvent cycle could replace some or all of the washing currently being done in water, which would result in a significant reduction in energy and water use.

There are currently commercial dry cleaning machines, which use a cyclic siloxane dry cleaning process, but these machines present several barriers to in-home use. Known commercial dry cleaning machines are generally much larger than typical home washing machines, and would not fit within typical washrooms. These commercial dry cleaning machines typically require high voltage power (>250V) and often require separate steam systems, compressed air systems, and chilling systems to be attached externally. The solvent amount generally stored in the commercial dry cleaning machines is usually more than about 190 liters, even for the smallest capacity commercial machines. The typical dry cleaning facility has both solvent cleaning and water cleaning machines on the premises and uses each machine for their separate functions. Known commercial dry cleaning machines are typically designed to be operated by a skilled employee and do not contain appropriate safety systems for either in-home locations or for general use. In many states, the use of commercial dry cleaning machines by the general public is forbidden.

U.S. patent application Ser. No. 10/127,001, titled "Apparatus and Method for Article Cleaning", filed on Apr. 22, 2002, commonly assigned to the same assignee of the present invention, represents one innovative implementation of an appliance that provides solvent, or water-based cleaning (or combination thereof). As set forth in the foregoing patent application, this appliance may be advantageously accommodated either in an in-home or in a coin-operable laundry setting. That is, an appliance that may be used not just for commercial dry cleaning applications, but also having the appropriate small size, cost, and user-interface considerations for a home-based laundry system.

Presently, the standard technique of solvent reclamation in a commercial dry cleaning process is distillation of the PERC solvent. Impurities may be concentrated in the distillate bottoms, and disposed of. Unfortunately, significant exposure to the solvent as well as the impurities is possible.

Another technique of solvent reclamation is through an adsorption system. Although known adsorption systems may provide some cleaning action to the solvent, this technique generally needs to be used in conjunction with a distillation set-up in order to provide long term use of the recycled solvent. In the industrial setting that this technique is used, the adsorption system typically requires use of large canisters that are cumbersome and may lead to user exposure to the solvent and contaminants.

Water removal in industrial dry cleaning equipment is usually minimal, and many dry cleaning machines are equipped with a decanter for this purpose. These known decanters are typically operated in a continuous fashion. It is believed that continuous operation of decanting equipment would not be suitable for home use.

In view of the foregoing considerations, it would be desirable to provide a system and process that is economically affordable for quickly and reliably purifying and reclaiming siloxane cleaning solvent for reuse, as may be utilized in a solvent cleaning appliance, such as described in U.S. patent application Ser. No. 10/127,001. It is further desirable that such a system be configurable to meet the unique considerations of an in-home appliance as well as those of commercial scale units, such as coin-operable laundry machines.

BRIEF DESCRIPTION

Generally, the present invention fulfills the foregoing needs by providing in one aspect thereof, an article cleaning apparatus comprising an air management mechanism, a cleaning basket assembly, a fluid regeneration device, a working fluid device, a clean fluid device, and a controller. The working fluid device is coupled to the fluid regeneration device, the cleaning basket assembly, and the air management mechanism. The working fluid device comprises a fluid filter/separator assembly for substantially removing an aqueous phase that may be present in a solvent-based cleaning fluid that passes therethrough. The clean fluid device is coupled to the cleaning basket assembly and the fluid regeneration device. The controller is coupled to the air management mechanism, the cleaning basket assembly, the working fluid device, the regeneration device, and the clean fluid device. The controller is configured to control a cleaning process.

The present invention further fulfills the foregoing needs by providing in another aspect thereof, a method for recovering and purifying a solvent used in an article cleaning appliance. The method allows passing solvent-based cleaning fluid from a wash basket through a coarse filter configured to remove relatively large particulates from the cleaning fluid. The method further allows passing cleaning fluid from the coarse filter through a particulate filter configured to remove relatively fine particulates from the cleaning fluid. An aqueous phase that may be present in the cleaning fluid is separated by decanting and coalescing through a separator/filter assembly. The cleaning fluid may then be passed through a regeneration cartridge for removing any water that may remain in the cleaning fluid, and for adsorbing organic contaminants that may be present in the cleaning fluid. Recovered solvent may be stored in a tank for subsequent use in a cleaning process performed by the appliance.

In yet another aspect thereof, the present invention provides apparatus for purifying and recovering a solvent used in an article cleaning appliance. The apparatus comprises a coarse filter coupled to receive solvent-based cleaning fluid from a wash basket, the coarse filter configured to remove relatively large particulates from the cleaning fluid. The apparatus further comprises a particulate filter coupled to receive cleaning fluid from the coarse filter. The particulate filter is configured to remove relatively fine particulates from the cleaning fluid. A fluid filter/separator assembly is coupled to receive cleaning fluid from the particulate filter. The assembly is configured to separate an aqueous phase that may be present in the cleaning fluid. A regeneration cartridge is coupled to receive cleaning fluid from the filter/separator assembly. The regeneration cartridge comprises water adsorption media for removing any water that may remain in the cleaning fluid. The regeneration cartridge further comprises adsorption media configured to adsorb organic contaminants that may be present in the cleaning fluid. A tank is provided for storing recovered solvent for subsequent use in a cleansing process performed by the appliance.

LIST OF FIGURES

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
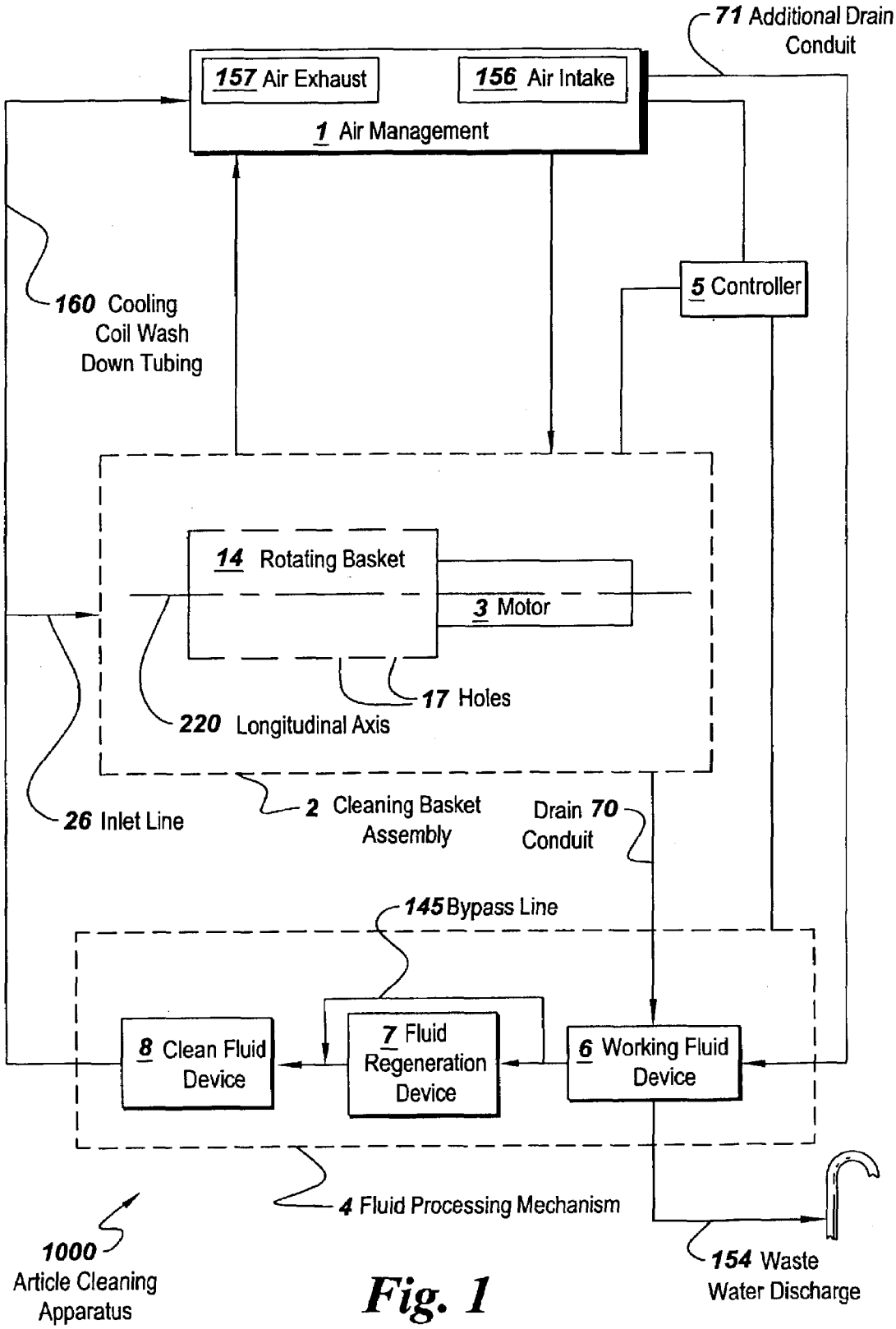
FIG. 1 is a block diagram of the article cleaning apparatus in accordance with one embodiment of the present invention.

The present invention includes an apparatus and method for the cleaning of articles,at home or in a coin-op laundry setting. As used herein, the term, "articles" is defined, for illustrative purposes and without limitation, as fabrics, textiles, garments, and linens and any combination thereof. As used herein, the term, "solvent based cleaning fluid" is defined for illustrative purposes and without limitation, as comprising a cyclic siloxane solvent and, optionally, a cleaning agent. If water is present in a solvent based cleaning fluid, the water is present in an amount in a range from about 1 percent to about 8 percent of the total weight of the solvent based cleaning fluid. In another embodiment of the present invention, if water is present in the solvent based cleaning fluid, the water is present in an amount in a range from about 1 percent to about 2 percent of the total weight of the solvent based cleaning fluid. As used herein, the term, "cleaning agent" is defined for illustrative purposes and without limitation, as being selected from the group consisting of sanitizing agents, emulsifiers, surfactants, detergents, bleaches, softeners, and combinations thereof. As used herein, the term, "water based cleaning fluid" is defined for illustrative purposes and without limitation, as comprising water and, optionally, a cleaning agent. In the present invention, the article cleaning apparatus 1000 of FIG. 1 is configured to perform a cleaning process 350 of FIG. 11. As used herein, the term, "cleaning process" is defined, for illustrative purposes and without limitation, as utilizing a solvent cleaning process 375, a water cleaning process 600, and any combination thereof. The solvent cleaning process 375 and the water cleaning process 600 are presented in more detail after the article description of the cleaning apparatus 1000 of FIG. 1. It is recognized that alternative configurations of the article cleaning apparatus 1000 are possible.

The article cleaning apparatus 1000 comprises the air management mechanism 1, the cleaning basket assembly 2, and a fluid regeneration device 7. The article cleaning apparatus 1000 further comprises a working fluid device 6 that is coupled to the fluid regeneration device 7, the cleaning basket assembly 2, and the air management mechanism 1. The article cleaning apparatus 1000 further comprises a clean fluid device 8 that is coupled to the cleaning basket assembly 2 and the fluid regeneration device 7. The article cleaning apparatus 1000 further comprises a controller 5 which is coupled to the air management mechanism 1, the cleaning basket assembly 2, the working fluid device 6, the regeneration device 7, and the clean fluid device 8. The controller 5 is configured to perform the cleaning process 350.

The cleaning basket assembly 2 of FIG. 1 typically comprises a rotating basket 14 coupled to a motor 3. The rotating basket 14 has a plurality of holes 17. The motor 3 rotates the rotating basket 14. Suitable drive system alternatives, presented for illustration and without limitation include, direct drive, pulley-belt drive, transmissions, and any combination thereof. The direct drive orientation of the rotating basket 14 and the motor 3 is provided for illustrative purposes and it is not intended to imply a restriction to the present invention. In one embodiment of the present invention (not shown in FIG. 1), the motor 3 has a different major longitudinal axis than the longitudinal axis 220 of the rotating basket 14, and the motor 3 is coupled to the rotating basket 14 by a pulley and a belt.

Figure 2:
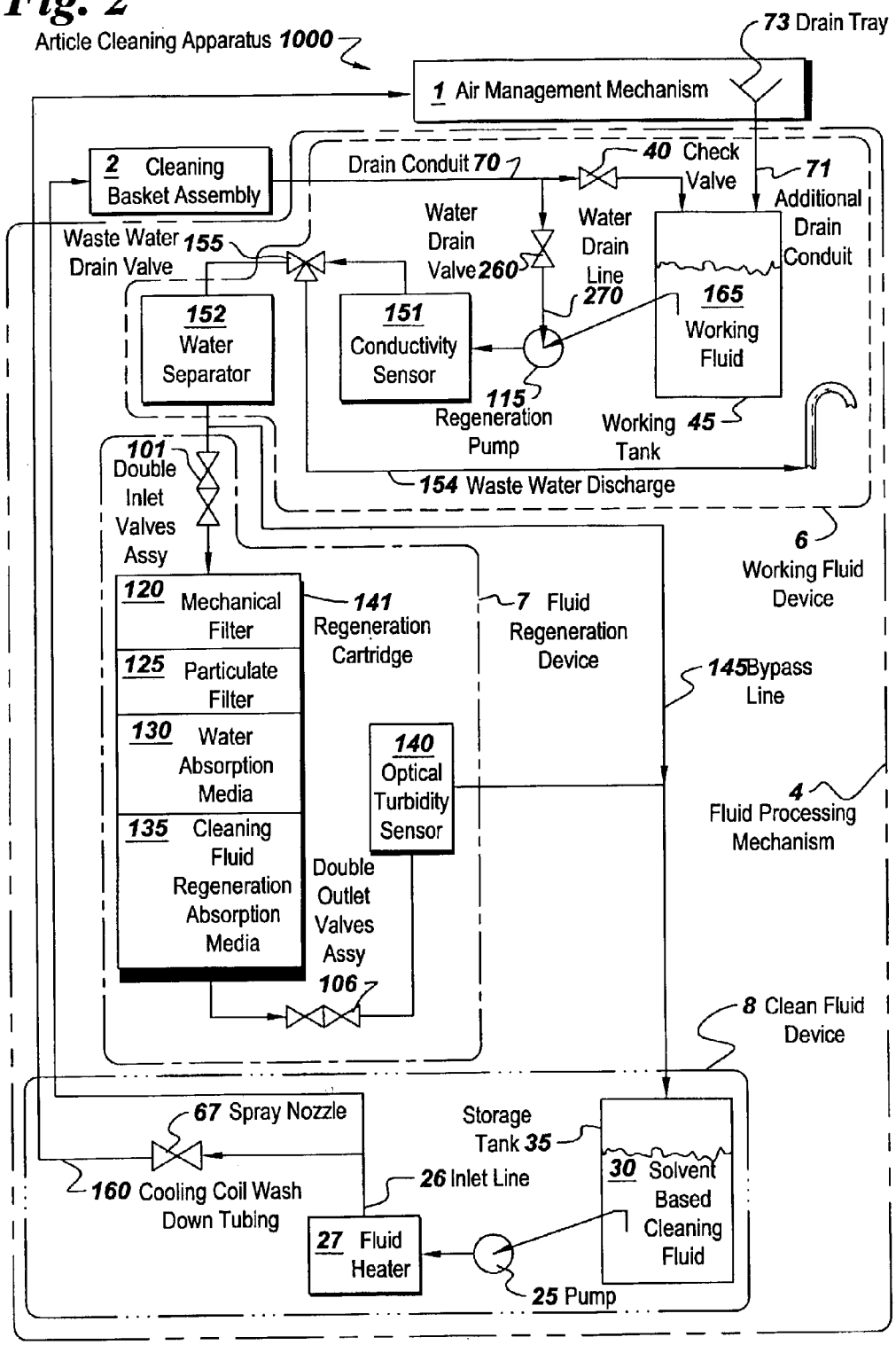
FIG. 2 is a schematic diagram of the fluid processing mechanism in accordance with one embodiment of the present invention.

As shown in FIG. 2, the working fluid device 6, the fluid regeneration device 7, and the clean fluid device 8 comprise a fluid processing mechanism 4.

In one embodiment of the present invention, the working fluid device 6 comprises a check valve 40 in a drain conduit line 70 that couples the cleaning basket assembly 2 to a working tank 45. Fluid from the cleaning basket assembly 2 passes through the check valve 40 and is collected in the working tank 45. The fluid in the working tank 45 is defined as a working fluid 165. A drain tray 73 is disposed in the air management mechanism 1 to collect condensate. An additional drain conduit 71 couples the working tank 45 to the drain tray 73. Condensate in the drain tray 73 is typically gravity drained to the working tank 45, where it is collected as part of the working fluid 165. A regeneration pump 115 is coupled to the working tank 45 and to a conductivity sensor 151. A waste water drain valve 155 is disposed between the conductivity sensor 151 and the fluid regeneration device 7. The waste water drain valve 155 is coupled to waste water discharge piping 154.

Figure 7:
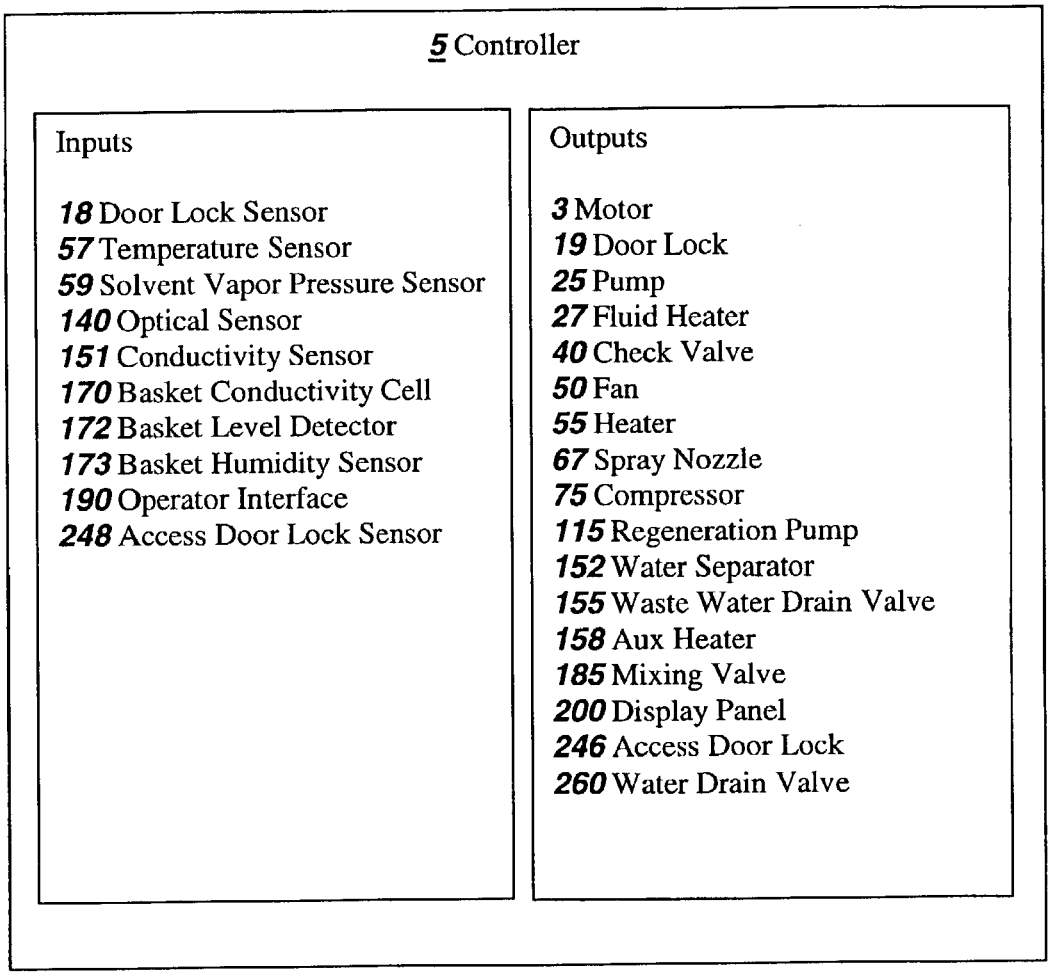
FIG. 7 is a schematic diagram of the devices coupled to the controller in accordance with one embodiment of the present invention.

In one embodiment of the present invention, the controller 5 of FIG. 7 is configured to direct the working fluid 165 of FIG. 2 through to the fluid regeneration device 7 when the conductivity sensor 151 indicates that the working fluid 165 comprises less than about 10% water by weight. The controller 5 of FIG. 7 is further configured to divert the working fluid 165 of FIG. 2 through the waste water drain valve 155 and the waste water discharge piping 154 when the working fluid 165 flowing through the conductivity sensor 151 comprises a minimum of at least about 10% by weight of water to avoid overwhelming the water adsorption capability of the fluid regeneration device 7.

In another embodiment of the present invention, a water separator 152 is disposed in the working tank 45. In another embodiment of the present invention, the water separator 152 is disposed between the waste water drain valve 155 and the fluid regeneration device 7. In another embodiment of the present invention, a bypass line 145 of FIG. 2 is disposed between the discharge of the water separator 152 and the inlet of the clean fluid device 8 to reduce the possibility of overwhelming the water removal capability in the fluid regeneration device 7. In another embodiment of the present invention (not shown in FIG. 2), the bypass line 145 is disposed between the waste water drain valve 155 and the clean fluid device 8. The bypass line 145 is typically sized to bypass a range from about one-quarter to about three-quarter of the total flow of the working fluid 165 around the fluid regeneration device 7.

In one embodiment of the present invention, the water separator 152 is fabricated from materials selected form the group consisting of calcined clay, water adsorbing polymers, sodium sulfate, paper, cotton fiber, lint, and any combination thereof. In another embodiment of the present invention, the water separator 152 comprises a distillation device that utilizes heat to remove water.

A desirable feature for a washer appliance embodying aspects of the present invention would be to provide at least three different operational (e.g., wash) cycle options, such as: Wash Cycle 1—an option for waterless wash, essentially using just solvent or solvent plus approximately 0.25 to 1.5% water or other polar solvent; Wash Cycle 2—an option for cleansing moderately soiled delicates, e.g., using a suitable spot-remover or pre-spotter and from approximately 1.0 to 6.5% water or other polar solvent; and Wash Cycle 3—a solvent/water/detergent option with approximately 4 to 15% water or other polar solvent and approximately 0.01 to 0.5% detergent by weight of the total fluid charge providing a more aggressive wash for heavy-duty laundry.

Removal of the aqueous phase before the solvent can be recycled is desirable. This is desirable both for carbon adsorption efficiency and to minimize odors and bacterial growth. In one exemplary embodiment, a desirable goal would be to provide approximately 98% water removal efficiency using a fluid filter/separator assembly 2000 (FIG. 17) comprising a decanter stage 2002 and a filter stage 2004. Suitable water adsorption media, such as adsorption media 3007, would handle any remaining water removal. To further enhance cleaning, in addition to the detergent, for example, surfactants and dodecylamine may be added to the working fluid.

Water/detergent (bottom or aqueous phase) that may be present in the working fluid (e.g., cleansing fluid) may be separated from the SB32 solvent by filter/separator assembly 2000. Decanter stage 2002 can be comprised of a water drain tube 2010, a water collector bowl 2012 and a turbine centrifuge 2014. In operation, decanter stage 2002 is in fluidic communication with filter stage 2004, as represented by the plurality of arrows indicative of various exemplary fluid flow paths shown in filter/separator assembly 2000. Filter stage 2004, in one exemplary embodiment, may be made of paper. In another exemplary embodiment, filter stage 2004 may comprise hydrophobic material, e.g., a polymer or resin-coated paper, designed to concentrate and contain the aqueous phase within the decanter while allowing passage to the non-polar phase, e.g., solvent. In one exemplary embodiment, the filter stage may comprise a single-ply, axially-pleated filter media 2005. As suggested above, the filter media may be treated to block passage to any fine droplets of water from the solvent passing therethrough. One exemplary type of hydrophobic media believed to be effective for purposes of the present invention, based on preliminary experimental results, is manufactured by Parker-Hannifin Corporation of Cleveland Ohio under the mark/designation Aqua-bloc. It will be understood that the composition, structure and efficiency of the filter media can be configured to match the particular needs of any given application. It will be appreciated that the filter media may be formed from conventional material and may be manufactured using conventional filter media manufacturing techniques. Commercially available filter/separator assemblies that are well suited to perform decanting and coalescing include, for example, the Amsoil/Dahl filter/separator assemblies Model Nos. ADF10, and ADF20, and the Racor filter/separator assembly Model No. 1000FG. Each of such filter/separator assemblies have been designed and used for fuel systems, such as diesel fuel systems, to remove water, the more dense phase, from the diesel fuel, which is slightly less dense, thereby allowing for clean, water-free fuel to pass for optimal engine performance. The inventors of the present invention have innovatively recognized that such fuel filter/separator assemblies may be advantageously used for achieving aspects of the present invention, such as removing the denser water phase from the slightly less dense, but immiscible silicone cleaning fluid (i.e., cyclic siloxane solvent).

For readers desirous of background information in connection with the physical science mechanisms involved in the settling (e.g., decanting), and coalescing stages of such filter/separator assemblies, reference is made to U.S. Pat. Nos. 4,298,465 and 3,931,011, each of which is incorporated herein by reference. The description provided in such patents should be construed as representative of the type of fluid filter/separator assembly contemplated in accordance with aspects of the present invention, and should not be construed as limiting the present invention. As used herein the expression "filter/separator assembly" refers to assemblies or apparatus that through respective mechanisms of fluid settling (e.g., decanting) and coalescing are able to substantially separate water from a fluid that is slightly less dense than water—traditionally fuel has comprised the fluid being separated from water. However, as innovatively recognized by the inventors of the present invention, in a washer appliance, such as described in U.S. patent application Ser. No. 10/127,001, the fluid being separated from water and/or cleaning agents comprises cyclic siloxane solvent.

Tests for determining water separation were conducted as follows: a gallon jug was filled with a gallon of D5 cleaning fluid and 100 ml of water/detergent. The phases were vigorously mixed with a mechanical stirrer (e.g., 500 rpm) to simulate mixing under washing conditions. The mixture was pumped with a peristaltic pump into the filter/separator assembly through an inlet port (e.g., inlet port 2009 (FIG. 17)) and descended to the decanting stage where relatively large droplets of the aqueous phase settled. The less dense D5 cleaning fluid phase ascended to the filter stage where relatively smaller droplets of the aqueous phase were separated. The separated D5 phase was passed through the filter medium and exited through an outlet port at (e.g., outlet port 2008 (FIG. 17)) at the top of the filter assembly while any remaining aqueous phase was blocked by the filter medium. The aqueous phase was collected in bowl 2012 at the bottom of the filter/separator assembly and was drained off as necessary through an outlet port (e.g., drain tube 2010 (FIG. 17)). The D5 fluid output was then analyzed using a suitable sensor for measuring water content and determining the water removal efficiency. Important operational parameters comprise providing relatively low water concentration in the stream of cleansing fluid at a relatively low operating pressure. In operation, the filter/separator assembly may allow bulk or substantial water removal (e.g., about 98%) and any small amount of remaining water may then be removed by water adsorption media 3007, such as adsorption media on a clay bed. Experiments were run for approximately 10 to 20 minutes and four samples were taken during each experiment.

The experimental results are summarized in Table 1 which is divided into 4 sections, I) Experiments with Dahl filter/separator assembly ADF10; II) Experiments with Dahl filter/separator assembly ADF20; III) Experiments with Racor filter/separator assembly 1000FG without surfactants and amine; and IV) Experiments with Racor filter/separator assembly 1000FG with surfactants and amine. As seen in the first section of Table 1, initial results with the Dahl ADF10 filter/separator assembly showed that at 400 ml/min, in the absence of any detergent, the aqueous phase can readily be removed to approximately 98–99% efficiency. However, at increased flow rates, e.g., 600 ml/min and with ⅛% detergent, the water removal efficiency was reduced to approximately 70%.

To achieve greater flow rates a larger fluid filter/separator assembly, the Dahl filter/separator assembly Model ADF20, was tested. Dahl filter/separator assembly ADF20 comprises an increased volumetric capacity (approximately 2.8 liters as compared to 0.85 liters for Dahl filter/separator assembly ADF10) and a corresponding increased residence time. In addition, the filter stage of filter/separator assembly ADF20 is larger and has a greater surface area than the one for filter/separator assembly ADF10. The second section of Table 1 showed some improved results. Efficient water removal (>99%) was achievable at increased flow rates with ⅛% detergent and with water levels of 2.5 and 5%.

To further enhance cleaning, in addition to the detergent, surfactants and dodecylamine were added to the cleansing fluid. As may be expected, this resulted in an aqueous phase that was relatively more difficult to separate. When surfactants and dodecylamine were added to the cleansing fluid, the performance of the Dahl filter/separator assembly ADF20 in terms of water removal efficiency dropped off to approximately 80%.

The next iteration of tests involved the Racor filter/separator assembly 1000FG. The volume of this filter assembly is slightly larger (approximately 3.2 liters) and has a filter stage, which is believed to be conducive to more efficient water separation. As suggested above, the filter element comprises a filter medium coated with a hydrophobic polymer or resin (traded in commerce under the mark/designation Aqua-bloc) designed to repel the aqueous phase. It should be recognized that any number of polymer compositions with hydrophobic character would be suited for this application. The filter element also has an exposed pleat design, which allows the aqueous phase to run off the filter element and down into the water-collecting bowl. The results were excellent under various testing conditions. Three different flow rates and two different pore size elements were tested. As seen in the third section of Table 1, with detergent only, the aqueous phase removal efficiency was >99% at flow rates as high as 1300 ml/min. The same set of tests was run with surfactants and amine as well as detergent. The results are listed in the fourth section of Table 1. Even under the most stringent conditions, e.g., the combination of detergent, surfactants and dodecylamine, the aqueous phase removal efficiency was excellent, e.g., approximately 99.6–99.7% at an exemplary flow rate of 650 ml/min for both the 10 and 30 micron pore size. At higher flow rates, e.g., 975 and 1300 ml/min, the 30-micron filter element performed slightly better than the 10-micron filter element. In view of the foregoing results, it is felt that aqueous phase removal, with or without surfactants, and dodecylamine has been experimentally demonstrated at flow rates sufficiently high to allow for relatively fast real-time reloading (e.g., recapturing, or recycling) of the solvent as a washing cycle is being performed.

As will be appreciated by those skilled in the art, other types of separators for polar/non-polar phase separations may be considered, such as centrifuge, or electrostatic-based separators, however, it is believed that the present relatively high cost of such separators would not provide an economically competitive solution at this time.

TABLE 1

Exemplary Conditions and Results Summary for Solvent Recovery Experiments

| Exp | Filter/separator Assembly Model | Filter medium | Pore Size, microns | Flow Rate, ml/min | Water, % | Deter, % | Surf + Amine | Ave Water Rem Eff % |
|---|---|---|---|---|---|---|---|---|
| I | Dahl-ADF 10 | Paper | 10 | 400 | 2.5 | 0 | NO | 98.6 |
| | Dahl-ADF 10 | Paper | 10 | 600 | 2.5 | 0 | NO | 95.0 |
| | Dahl-ADF 10 | Paper | 10 | 400 | 2.5 | ⅛ | NO | 97.6 |
| | Dahl-ADF 10 | Paper | 10 | 600 | 2.5 | ⅛ | NO | 70.0 |
| II | Dahl-ADF 20 | Paper | 10 | 650 | 2.5 | ⅛ | NO | 99.3 |
| | Dahl-ADF 20 | Paper | 10 | 650 | 5 | ⅛ | NO | 99.1 |
| | Dahl-ADF 20 | Paper | 10 | 650 | 5 | ⅛ | YES | 80.9 |
| III | Recor-1000FG | Hydrophobic Coating | 10 | 650 | 5 | ⅛ | NO | 99.7 |
| | Recor-1000FG | Hydrophobic Coating | 10 | 975 | 5 | ⅛ | NO | 99.8 |
| | Recor-1000FG | Hydrophobic Coating | 10 | 1300 | 5 | ⅛ | NO | 99.7 |
| | Recor-1000FG | Hydrophobic Coating | 30 | 650 | 5 | ⅛ | NO | 99.3 |
| | Recor-1000FG | Hydrophobic Coating | 30 | 975 | 5 | ⅛ | NO | 99.4 |
| | Recor-1000FG | Hydrophobic Coating | 30 | 1300 | 5 | ⅛ | NO | 99.0 |
| IV | Recor-1000FG | Hydrophobic Coating | 10 | 650 | 5 | ⅛ | YES | 99.7 |
| | Recor-1000FG | Hydrophobic Coating | 10 | 975 | 5 | ⅛ | YES | 92.6 |
| | Recor-1000FG | Hydrophobic Coating | 10 | 1300 | 5 | ⅛ | YES | 87.0 |
| | Recor-1000FG | Hydrophobic Coating | 30 | 650 | 5 | ⅛ | YES | 99.6 |
| | Recor-1000FG | Hydrophobic Coating | 30 | 975 | 5 | ⅛ | YES | 98.6 |
| | Recor-1000FG | Hydrophobic Coating | 30 | 1300 | 5 | ⅛ | YES | 92.5 |

Figure 18:
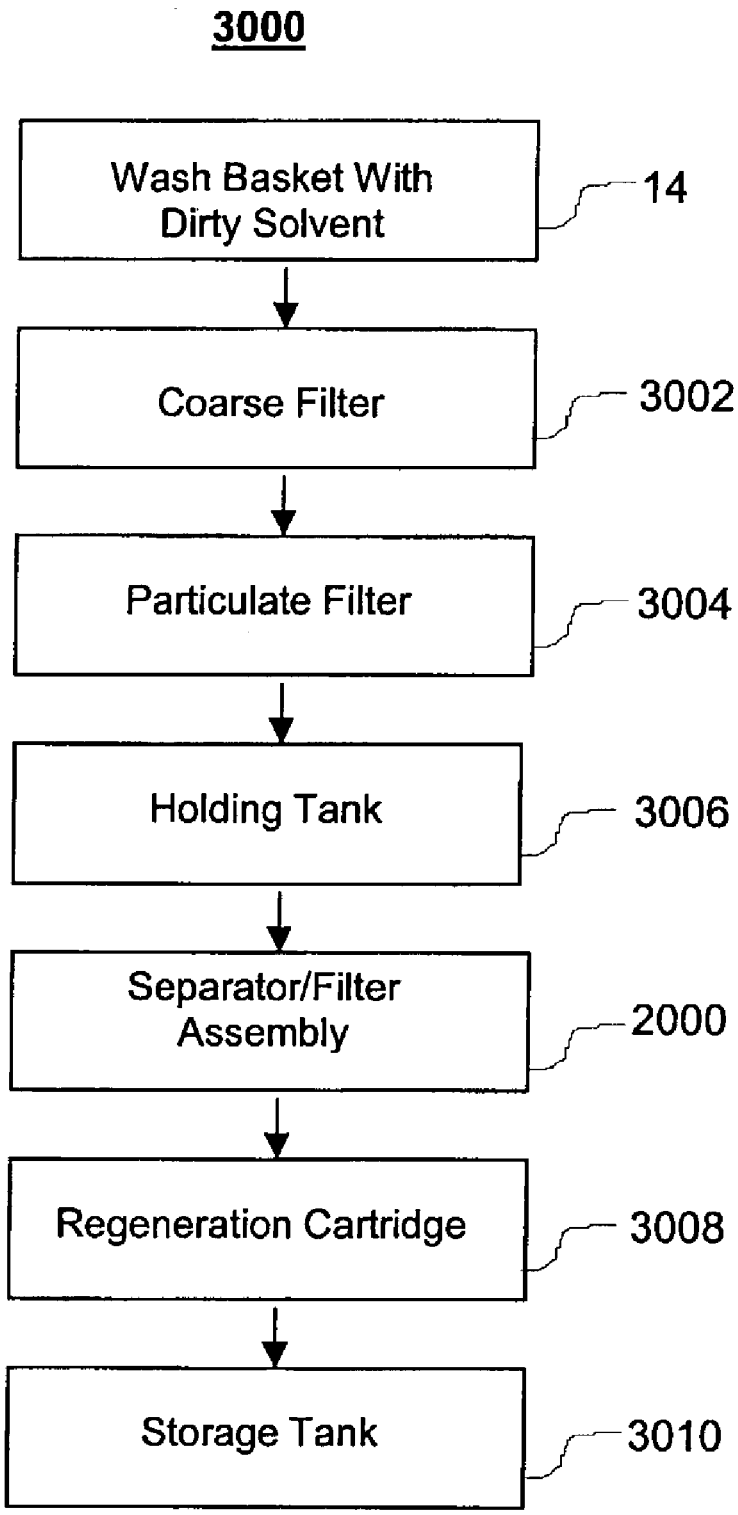
FIG. 18 illustrates an exemplary process flow for performing recovery and purification of dirty solvent using the solvent purification system of FIG. 17.

FIG. 18 illustrates an exemplary process flow 3000 for performing recovery and purification of dirty solvent and/or cleaning agents. For example, after the clothes have been washed in the wash basket 14, the dirty cleaning fluid would be drained from the basket, and passed through a coarse filter 3002. This filter may have a relatively large mesh configured to remove lint or fibers, which may be loosened from the clothing during wash and remain in the contaminated solvent upon draining of the basket. Coarse filter 3002 may be viewed as one exemplary embodiment of mechanical filter 120 (FIG. 2), and thus, unless stated otherwise, the structural description provided for mechanical filter 120 is also be applicable to coarse filter 3002. The fluid from coarse filter 3002 would then be passed through a particulate filter 3004 configured with a finer mesh and, in one exemplary embodiment, may comprise, for example, a spun or wound cartridge filter made up of polypropylene or polyester. Particulate filter 3004 may be viewed as one exemplary embodiment of particulate filter 125 (FIG. 2)), and thus, unless stated otherwise, the structural description provided for particulate filter 125 is also be applicable to particulate filter 3004.

After passing the cleaning fluid through the coarse and particulate filters to capture solids, the cleaning fluid may be optionally stored in a holding tank 3006 for further purification processing. In one exemplary embodiment, the purification process may continue immediately upon receiving fluid into the holding tank, or, in an alternative embodiment, the fluid may be stored for later purification.

Figure 17:
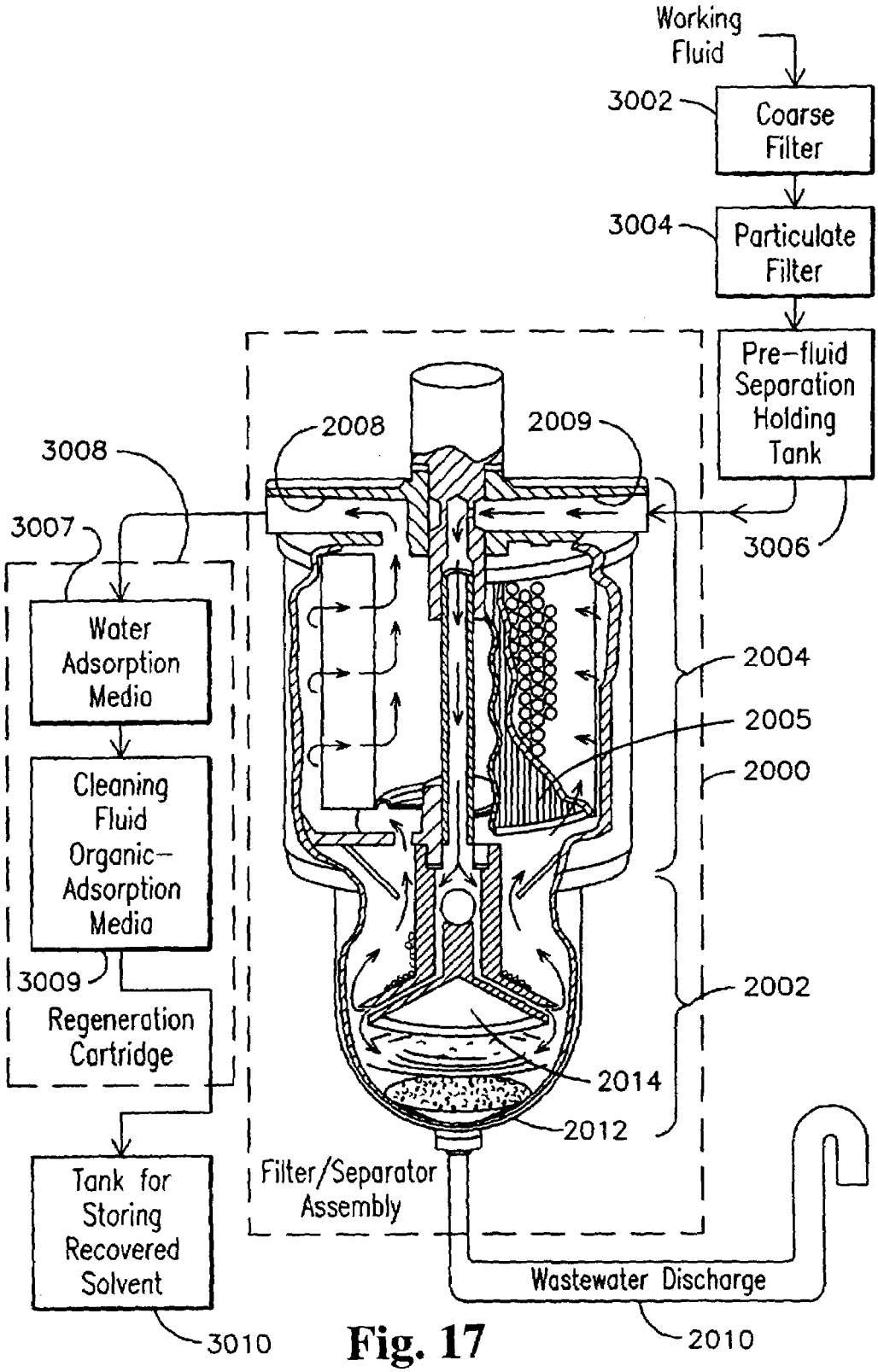
FIG. 17 is a schematic diagram of a solvent purification system in accordance with one exemplary embodiment of the present invention, and including a filter/separator assembly for substantially separating water and/or detergent from cyclic siloxane solvent.

As described in detail in the context of FIG. 17, bulk water separation is performed through filter/separator assembly 2000. Impurities in the solvent that may pass from filter/separator assembly 2000 could be concentrated and removed via distillation. However, in one exemplary embodiment, a regeneration cartridge 3008 may be configured to function as an impurity concentrator that may comprise an adsorption column. Regeneration cartridge 3008, water adsorption media 3007, and an organic adsorption media 3009 may each be viewed as respective exemplary embodiments of regeneration cartridge 141, water adsorption media 130 and cleaning fluid regeneration adsorption media 135, each shown in FIG. 2. Thus, unless stated otherwise, the structural description respectively provided for each of the last-recited components may also be applicable to regeneration cartridge 3008, water adsorption media 3007, and organic adsorption media 3009. In one exemplary embodiment, regeneration cartridge 3008 may be comprised of at least two sections: water adsorption media 3007, such as calcined clay, for the removal of small amounts of residual water not removed through the fluid separation action provided by filter/separator assembly 2000. Regeneration cartridge 3008 may be further made up of organic adsorbent media 3009, e.g. carbon, arranged to adsorb dissolved organic impurities, such as fats and oils. In one exemplary embodiment, the organic adsorption media 3009 may be a packed bed column with a length-to-diameter ratio of at least two. However, the organic adsorbent media may comprise a spin filter, flat plate bed, tortuous path bed, membrane separator, or other similar adsorption arrangement. The flow direction may be upflow or downflow, horizontal, or radial flow, although it may be desirable to minimize channeling for superior adsorption performance. The organic adsorption media may be selected from any material that is effective for removing dissolved organic impurities, such as activated carbon, carbon nanotubes, clay, adsorption resins (especially carbonaceous type, e.g., Ambersorb 563), silica, alumina, and zeolites. In one exemplary embodiment, activated carbon is used because of the high adsorption capacity and relatively low cost of activated carbon.

As suggested above, the adsorption media may comprise an array of packed bed columns or cartridges and may be in the form of a single cartridge or groups of cartridges in parallel and/or series. Cartridges coupled in parallel may provide a more convenient size for handling and can increase the L/D ratio of the cartridge bed without changing the total cartridge volume. Cartridges coupled in series can increase adsorption capacity as well as increase processing speed. A design with multiple cartridges may also be placed on a carousel for accessibility and ease of replacement.

As will be now appreciated by those skilled in the art, the size of the cartridge comprising the adsorption media is believed to be an important design parameter. While a large adsorbent bed or cartridge would remain in service for longer periods, a large bed or cartridge may be cumbersome, occupy significant space in the appliance and may be difficult for one individual to replace. In one exemplary embodiment, based on preliminary small-scale lab experiments, the organic adsorption media may be comprised of an 18 liter cartridge and may include a total of 15 lbs of carbon. An exemplary target for the solvent purification time would be approximately eight minutes and the cartridge would be replaced approximately every 3 months or 100 washes (approximately 800 lbs. of clothing). It is contemplated, however, that for some applications a smaller cartridge may be desirable, e.g., it would save space and could be replaced easily by a single individual. It is further contemplated to regenerate the carbon and/or clay portions of the cartridge for reuse. For home use equipment, it is desirable to have a relatively small size for the cartridge, as well as small machine size. It is also desirable to have the capability of cleaning several loads of clothing sequentially, without having a large storage tank of clean solvent, and thus, instant or rapid reload of purified solvent would be desirable. Another exemplary embodiment contemplates a single cartridge with two bed sections. In this embodiment, the cartridge may comprise a carbon bed containing approximately 3.75 lbs. of carbon to remove dissolved impurities in the solvent. A second section of the cartridge may comprise clay for water adsorption. The percent of clay in this cartridge section may vary from about 0% to about 50% of the carbon weight, depending on the separation efficiency of the fluid filter/separator assembly and the quantity of water used in the wash load. For this embodiment, the regeneration cartridge may be replaced approximately every 22 washes. One exemplary temperature range for solvent processing may be approximately 20–40 degrees Calcius.

Exemplary configurations for the components used for solvent purification and recovery may include separate filters for the respective coarse and particulate filters, and the organic adsorption media, or, in an alternative arrangement, each may be combined as an "all-in-one" unitary regeneration cartridge. In the case of separate filters (e.g., separate coarse and particulate filters), it may be desirable to arrange for these filters to be upstream of holding tank 3006 to avoid settling of any contaminants at the bottom of the tank. In the case of a unitary regeneration cartridge, it may be desirable to pass the solvent through the unitary cartridge at least twice. The first pass may be performed at a relatively high flow rate (e.g., first flow rate) to primarily remove, for example, lint and particulates. A subsequent pass may be performed at a lower flow rate (e.g., second flow rate), which may be desirable for facilitating adsorption of soluble organic contaminants. The fluid filter/separator assembly 2000 may be situated anywhere upstream of the regeneration cartridge as either an integral component of the unitary cartridge, or as a separate unit.

In one exemplary embodiment, the first and second flow rates for purifying and recovering the solvent may be configured to reduce cycle time and use a relatively small storage tank (e.g., tank size of approximately 10 gal) for the recovered and purified solvent, see Scenario 1) in Table 2 below. Table 2 further illustrates two additional exemplary scenarios for purifying the solvent. Scenario 2) contemplates one single relatively slower flow rate (e.g., approximately 0.172 gal/min or 1304 mm/min) that would result in a longer overall cycle time. Scenario 3 contemplates a relatively larger tank (e.g., tank size is approximately 15 gal) and the single relatively slower flow rate. Still another scenario that is contemplated (not specifically illustrated in Table 2) would be to provide one relatively faster flow rate that would result in either a smaller tank size and/or a shorter total cycle time. It will be appreciated that the foregoing numerical values are merely illustrative and should not be construed as limiting the present invention since the values of flow rates and tank size may be adjusted to meet the requirements of any given application.

TABLE 2

| Scenario | Tank Size gal | 1st Flow Rate gal/min | 2nd Flow Rate gal/min | Total Cycle Time minutes |
|---|---|---|---|---|
| 1 | 10 | 0.344 | 0.172 | 90 |
| 2 | 10 | 0.172 | Not Applicable | 100 |
| 3 | 15 | 0.172 | Not Applicable | 90 |

Means for introducing additives, such as detergents, perfumes, disinfectants, etc., may be positioned at or near the exit side of the organic adsorption media for dispensing these additives into the solvent exiting the column for a subsequent wash as the solvent from a present or a previous wash is purified for storage in a tank 3010 for holding the recovered (e.g., purified solvent).

It is contemplated that any spent cartridges may be appropriately disposed of or recycled to conserve adsorbent and SB32 solvent. For example, solvent may be drained prior to removal of the cartridge to minimize solvent replacement. Clean "make-up" solvent for replenishment purposes can be added back to the system by storing it in the replacement cartridge. Each cartridge may be configured with leak proof seals to reduce the possibility of leaks and fluid contact with the user. Each cartridge may be appropriately cleansed for recycling purposes either within the appliance or at a location off-line by backflushing the respective particulate and coarse filters and then passing a de-adsorption solvent over the adsorbent bed, such as clean silicone solvent, steam, or water. Solvent condensed in the drying system may be respectively passed through the water separator and the coarse and particulate filters for washing, rinsing, or backflushing of impurities in the solvent recovery system.

To enable sequential washes with immediate or rapid solvent reload, it would be desirable to, for example, purify the solvent during the drying cycle or store a sufficient amount of clean solvent for reload, or both. One exemplary method for enhancing this solvent reload capability while reducing adsorbent bed volume would be to process the solvent at a sufficiently high flow rate to partially remove contaminants from the solvent. The solvent can then be re-processed when the sequence of washes ends so that any remaining contaminants in the solvent are removed. The re-processing steps may comprise at least a second or third pass through the purification system, reprocessing at a slower rate and continuing until removing the contaminants to a desired level.

Another exemplary technique for enabling rapid reload capability with reduced cartridge size and reduced processing time would be to pass the solvent through each respective filter, e.g., the coarse and particulate filters, and the organic adsorption bed (or the unitary cartridge assembly) at a relatively high flow rate. The partially cleaned solvent can then be diluted or mixed with previously purified solvent to enable immediate reload with the mixed partially purified, or "gray" solvent. It is contemplated to dilute the partially cleaned solvent with at least 50% of purified solvent to avoid any relatively high contamination to the overall mix. The mixed partially purified solvent may then be more highly purified when the sequence of washes ends. It is contemplated that if the cartridge is sized such that the processing time for recovering and purifying the solvent exceeds the processing time for the remainder of the cycle, one may optionally pass the solvent just through the coarse and particulate filters for a desired number of wash cycles. Any organic soluble contaminants in the solvent may then be removed via the organic adsorption media later. Another option would be to continuously process the contaminated solvent by recycling. Although this option may allow for faster processing and smaller adsorption beds, this option may require a tank with larger storage capacity for the purified solvent.

One exemplary flow rate of solvent through the purification column, based on a given volume for the carbon bed, is approximately 6 bed volumes/hr. The system may be run at flow rates ranging from approximately 3–9 bed volumes/hr with diminishing benefit at lower flow rates, or higher ones. After a sequence of approximately 3–6 wash loads, the solvent may be more thoroughly cleaned upon passing a second time through the purification system. A large solvent purification bed can also be utilized to maximum advantage if several machines are connected to a single solvent recovery system, such as may be the case at coin-operated laundry facilities, or in a larger scale device.

In certain instances, where it is desirable to wash with an aqueous phase comprising soluble detergent, it is also desirable to rinse the wash load for removing the detergent from the clothing. In these instances, it may be desirable to rinse the clothing with a mixture of solvent and water, which, as suggested above, would be subsequently processed through the fluid filter/separator assembly 2000 to remove the aqueous phase from the mixture. For example, to enable the rinse immediately following a wash and spin cycle, either clean solvent for the rinse should be retrieved from storage, or the wash fluid should be processed through the fluid filter/separator assembly during such drain and spin cycles, or both. For example, solvent for the rinse may be generated from wash fluid from the holding tank and passed through the fluid filter/separator assembly. The solvent may then be optionally passed through the adsorption bed and returned for the rinse, or the solvent may bypass the adsorption bed, and be returned for rinsing. In one exemplary embodiment, a portion of the clean solvent for rinsing may be extracted from previously purified solvent stored in storage tank 3010, and another portion of the solvent for rinsing may be processed (e.g., recovered) from the wash fluid. This combination is believed to allow both reducing the size of the tank for storing clean solvent and reducing the flow rate of fluid through the fluid filter/separator assembly. In one exemplary embodiment, the wash fluid volume may comprise approximately 60–90% of the volume of the clean solvent storage tank (e.g., 6–10 gallon wash cycle, and a 10–15 gallon clean solvent storage tank). The rinse may utilize a solvent volume which comprises approximately 40%–100% of the volume of the wash solvent volume and a water volume which is approximately 0%–8% of the rinse solvent volume. For this exemplary solvent volume, approximately 45% would be stored in the tank for storing clean solvent, and approximately 55% would be processed from the wash cycle.

The fluid regeneration device 7 comprises a regeneration cartridge 141. The inlet side of the regeneration cartridge 141 is typically coupled to the working fluid device 6. The regeneration cartridge 141 typically comprises at least a water adsorption media 130 coupled to a cleaning fluid regeneration adsorption media 135. In one embodiment of the present invention, the regeneration cartridge 141 further comprises a mechanical filter 120 and a particulate filter 125. In one embodiment of the present invention, the working fluid 165 passes sequentially through the mechanical filter 120, particulate filter 125, water adsorption media 130, and cleaning fluid regeneration adsorption media 135. The cleaning fluid regeneration adsorption media 135 contains a portion of the solvent based cleaning fluid 30 in order to replenish the solvent based cleaning fluid 30 that is consumed during the solvent wash/dry process 500 of FIG. 13. The cleaning fluid regeneration adsorption media 135 also contains a replacement amount of solvent based cleaning fluid 30 which is disposed of when changing out the regeneration cartridge 141.

In one embodiment of the present invention, the cleaning fluid regeneration adsorption media 135 is selected from a group consisting of a packed bed column, a flat plate bed, a tortuous path bed, a membrane separator, a column with packed trays, and combinations thereof.

In one embodiment of the present invention, the materials to fabricate the cleaning fluid regeneration adsorption media 135 are selected from the group consisting of activated charcoal, carbon, calcined clay, Kaolinite, adsorption resins, carbonaceous type resins, silica gels, alumina in acid form, alumina in base form, alumina in neutral form, zeolites, molecular sieves, and any combination thereof. Both the amount of solvent based cleaning fluid regeneration and the speed of solvent based cleaning fluid regeneration depend on the volume of the cleaning fluid regeneration adsorption media 135.

In one embodiment of the present invention, the regeneration cartridge 141 containing the cleaning fluid regeneration adsorption media 135 in the packed bed column form is disposed in a single packed bed column cartridge form. In another embodiment of the present invention, the regeneration cartridge 141 comprising the cleaning fluid regeneration adsorption media 135 in the packed bed column form is disposed in a plurality of packed bed column cartridges. In an alternative embodiment of the present invention, the regeneration cartridge 141 comprises the cleaning fluid regeneration adsorption media 135 in a plurality of packed bed column cartridges, which are disposed in series with respect to one another. In yet another embodiment of the present invention, the regeneration cartridge 141 further comprises the cleaning fluid regeneration adsorption media 135 in the plurality of packed bed column cartridges, which are disposed in parallel with respect to one another.

Figure 3:
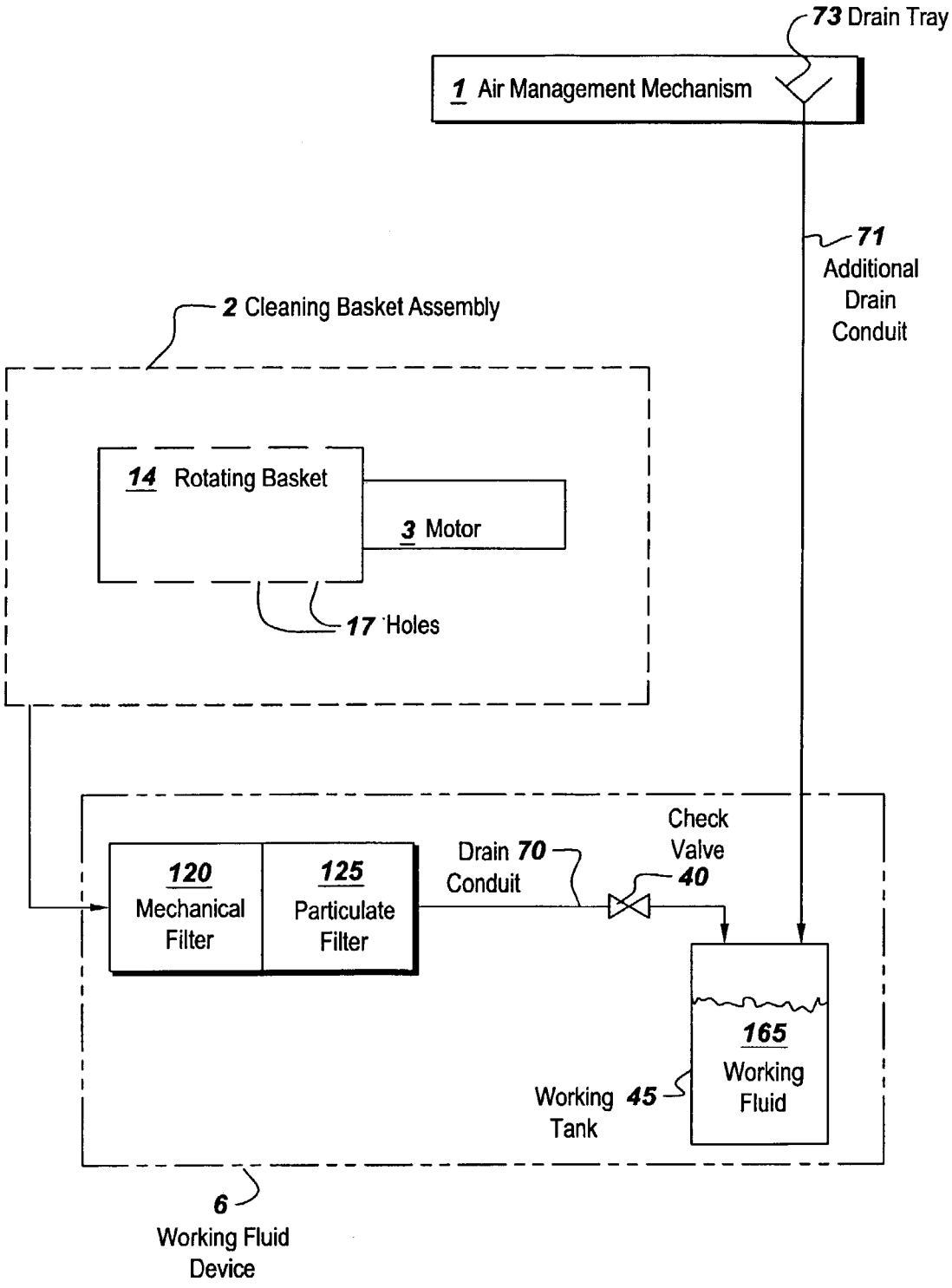
FIG. 3 is a schematic diagram of a filter arrangement in accordance with one embodiment of the present invention.

In another embodiment of the present invention, the mechanical filter 120 of FIG. 3 and the particulate filter 125 are part of the working fluid device 6. The mechanical filter 120 and the particulate filter 125 are disposed in the drain conduit line 70 that couples the cleaning basket assembly 2 to the working tank 45. The mechanical filter 120 and the particulate filter 125 are disposed in the drain conduit 70 between the cleaning basket assembly 2 and the check valve 40.

Figure 4:
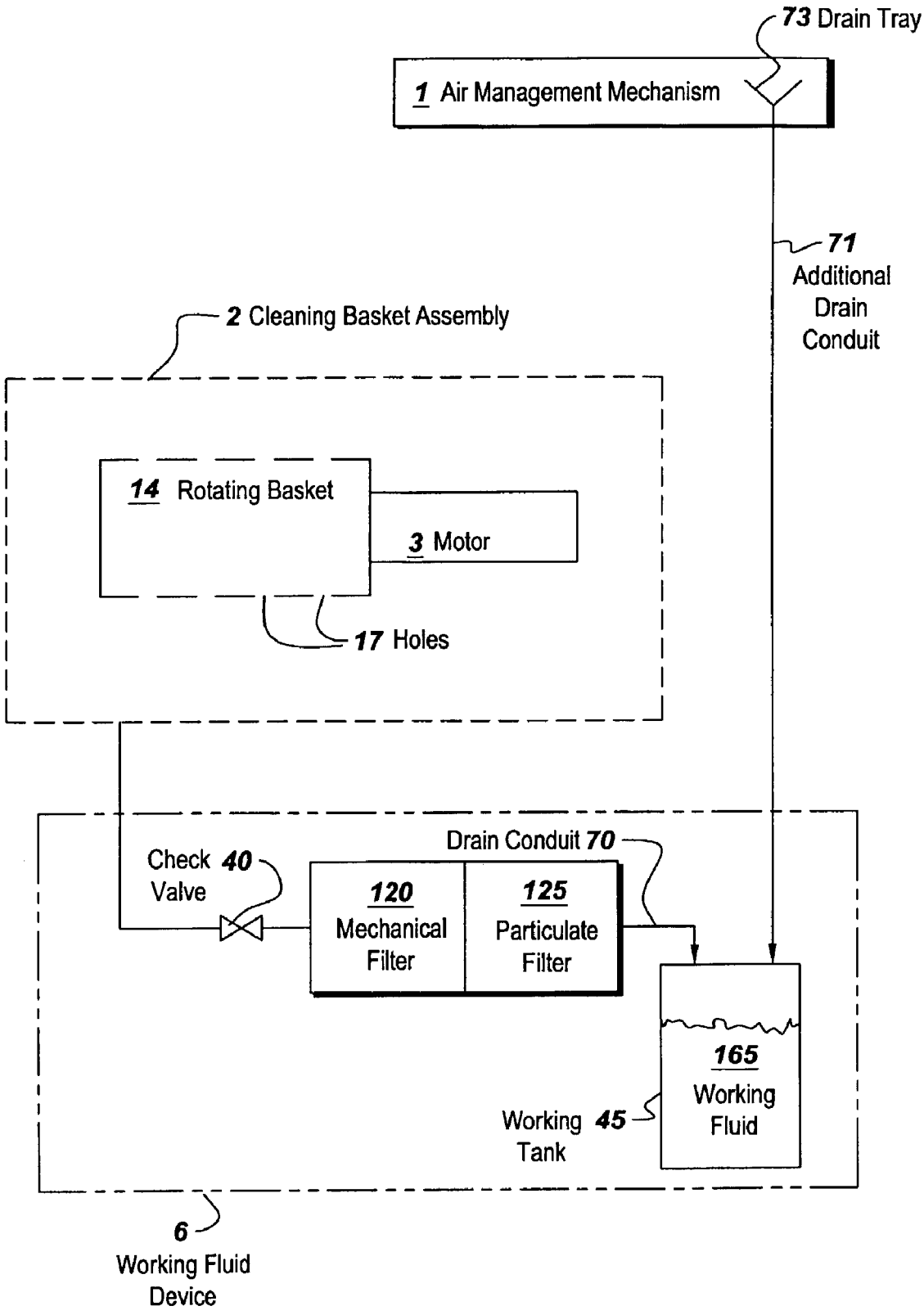
FIG. 4 is a schematic diagram of a filter arrangement in accordance with another embodiment of the present invention.

In another embodiment of the present invention, the mechanical filter 120 of FIG. 4 and the particulate filter 125 are disposed in the drain conduit 70 between the check valve 40 and the working tank 45. In an alternative embodiment of the present invention, the mechanical filter 120 is disposed in the drain conduit 70, while the particulate filter 125 is disposed in the regeneration cartridge 141. In another embodiment of the present invention, the mechanical filter 120 is not present and the particulate filter 125 is disposed in the regeneration cartridge filter 141. In another embodiment of the present invention, the mechanical filter 120 is not present and the particulate filter 125 is disposed in the drain conduit 141. Both the arrangement of the internals of the regeneration cartridge 141 and the location and application of the mechanical filter 120 and the particulate filter 125 are provided for illustrative purposes and are not intended to imply a restriction on the present invention.

In one embodiment of the present invention, mechanical filter 120 has a mesh size in a range from about 50 microns to about 1000 microns. In one embodiment of the present invention, the particulate filter 125 has a mesh size in a range from about 0.5 microns to about 50 microns.

In one embodiment of the present invention, the particulate filter 125 is a cartridge filter fabricated from materials selected from the group consisting of thermoplastics, polyethylene, polypropylene, polyester, aluminum, stainless steel, metallic mesh, sintered metal, ceramic, membrane diatomaceous earth, and any combination thereof.

Figure 9:
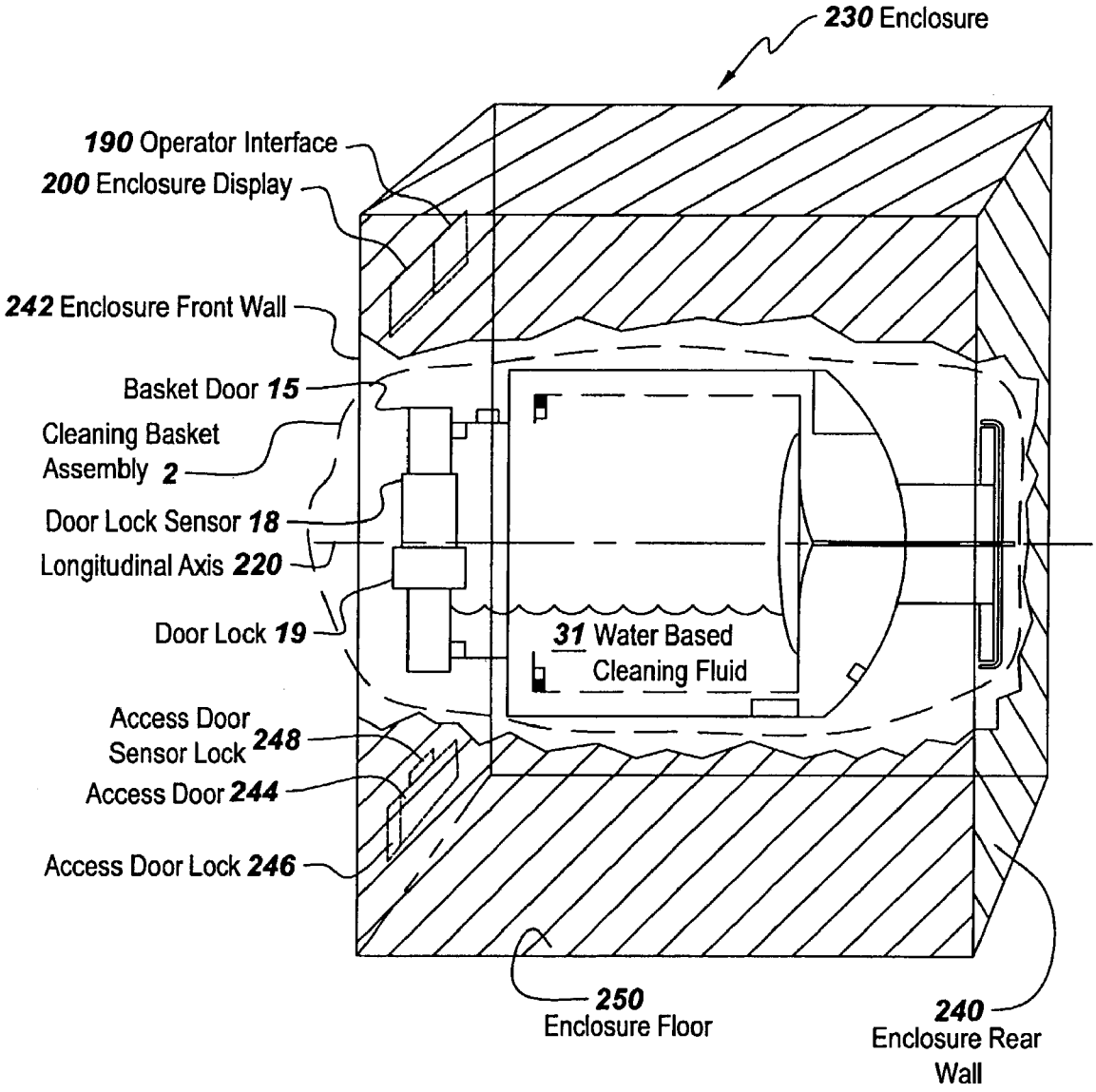
FIG. 9 is a three-dimensional partial cross sectional view of the article cleaning apparatus in accordance with one embodiment of the present invention.

After the working fluid 165 passes through the regeneration cartridge 141, it exits the regeneration cartridge 141 as the solvent based cleaning fluid 30. An outlet side of the regeneration cartridge 141 is typically coupled to an optical turbidity sensor 140. The optical turbidity sensor 140 is typically coupled to a storage tank 35 in the clean fluid device 8. The optical turbidity sensor 140 is tuned to a specific adsorbance level that provides information about the cleanliness of the solvent based cleaning fluid 30. When the solvent based cleaning fluid 30 exiting the optical turbidity sensor 140 reaches a preset specific adsorbance level, the controller 5 of FIG. 7 sends a "replace regeneration cartridge" message to the operator on a display panel 200 (FIG. 9).

The storage tank 35 of FIG. 2 in the clean fluid device 8 stores the solvent based cleaning fluid 30 received from the fluid regeneration device 7. The clean fluid device 8 further comprises a pump 25 that is coupled to the storage tank 35. The pump 25 is coupled to the cleaning basket assembly 2 via an inlet line 26. In one embodiment of the present invention, the pump 25 is also typically coupled to the air management mechanism 1 via cooling coil wash down tubing 160. In another embodiment of the present invention, the clean fluid device 8 further comprises a spray nozzle 67 that is typically disposed in the cooling coil wash down tubing 160 to control the flow of the solvent based cleaning fluid 30 to the air management mechanism 1. As used herein, the term, "spray nozzle" is defined to be a nozzle, an orifice, a spray valve, a pressure reducing tubing section, and any combination thereof. In one embodiment of the present invention, the spray nozzle 67 is coupled to the controller 5 as is shown in FIG. 7 when the spray nozzle 67 is a spray valve.

Figure 5:
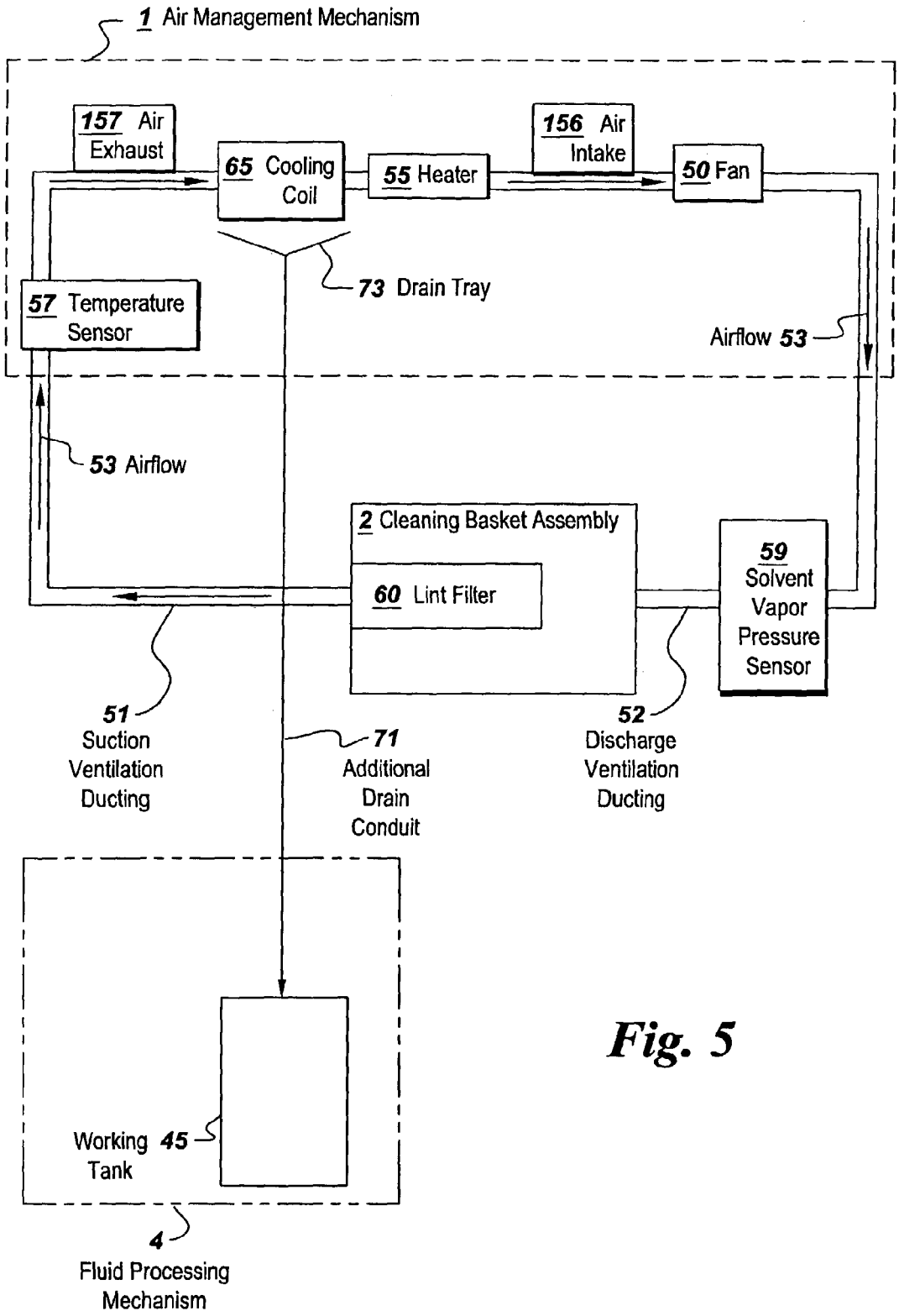
FIG. 5 is a schematic diagram of the air management mechanism and the cleaning basket assembly in accordance with one embodiment of the present invention.

The air management mechanism 1 of FIG. 5 comprises a cooling coil 65, a heater 55, and a fan 50. The air management mechanism 1 is coupled to the cleaning basket assembly 2 by suction ventilation ducting 51 and discharge ventilation ducting 52. The fan 50 is disposed to provide airflow 53 through the cooling coil 65, the heater 55, the discharge ventilation ducting 52, the cleaning basket assembly 2, and the suction ventilation ducting 51. A temperature sensor 57 is also typically disposed in the airflow 53. The temperature sensor 57 is typically disposed in the suction ventilation ducting 51, the discharge ventilation ducting 52, the cleaning basket assembly 2, and any combination thereof.

The cooling coil 65 is configured to have a cooling medium disposed to flow across one side of a heat transfer surface of the cooling coil 65, while the airflow 53 passes across the opposite side of the heat transfer surface of the cooling coil 65. The heat transfer surface of the cooling coil 65 separates the cooling medium and the airflow 53. The inlet temperature of the cooling medium utilized is typically cooler that the temperature of the airflow 53 in order to condense vapors in the airflow 53. As used herein, the term, "cooling medium" is defined, for illustrative purposes and without limitation, as being selected from water, refrigerants, air, other gasses, ethylene glycol/water mixtures, propylene glycol/water mixtures and any combination thereof. The drain tray 73 is disposed under the cooling coil 65 and is coupled to the working tank 45 as described above.

In one embodiment of the present invention, the air management mechanism 1 typically further comprises an air intake 156 and an air exhaust 157. The air intake 156 and air exhaust 157 are disposed to provide air exchange between the airflow 53 and the air that is outside of the air management mechanism 1 to promote the drying of articles that have been subjected to the water cleaning process 600 of FIG. 14. The air intake 156 and air exhaust 157 are disposed in a similar configuration to that of a conventional dryer. In one embodiment of the present invention, the air intake 156 of FIG. 5 is disposed in the ventilation path between the heater 55 and the fan 50, while the air exhaust 157 is disposed between the cooling coil 65 and the cleaning basket assembly 2. The locations of the air intake 156 and air exhaust 157 are provided for illustration and in no way implies a restriction to the present invention.

Figure 6:
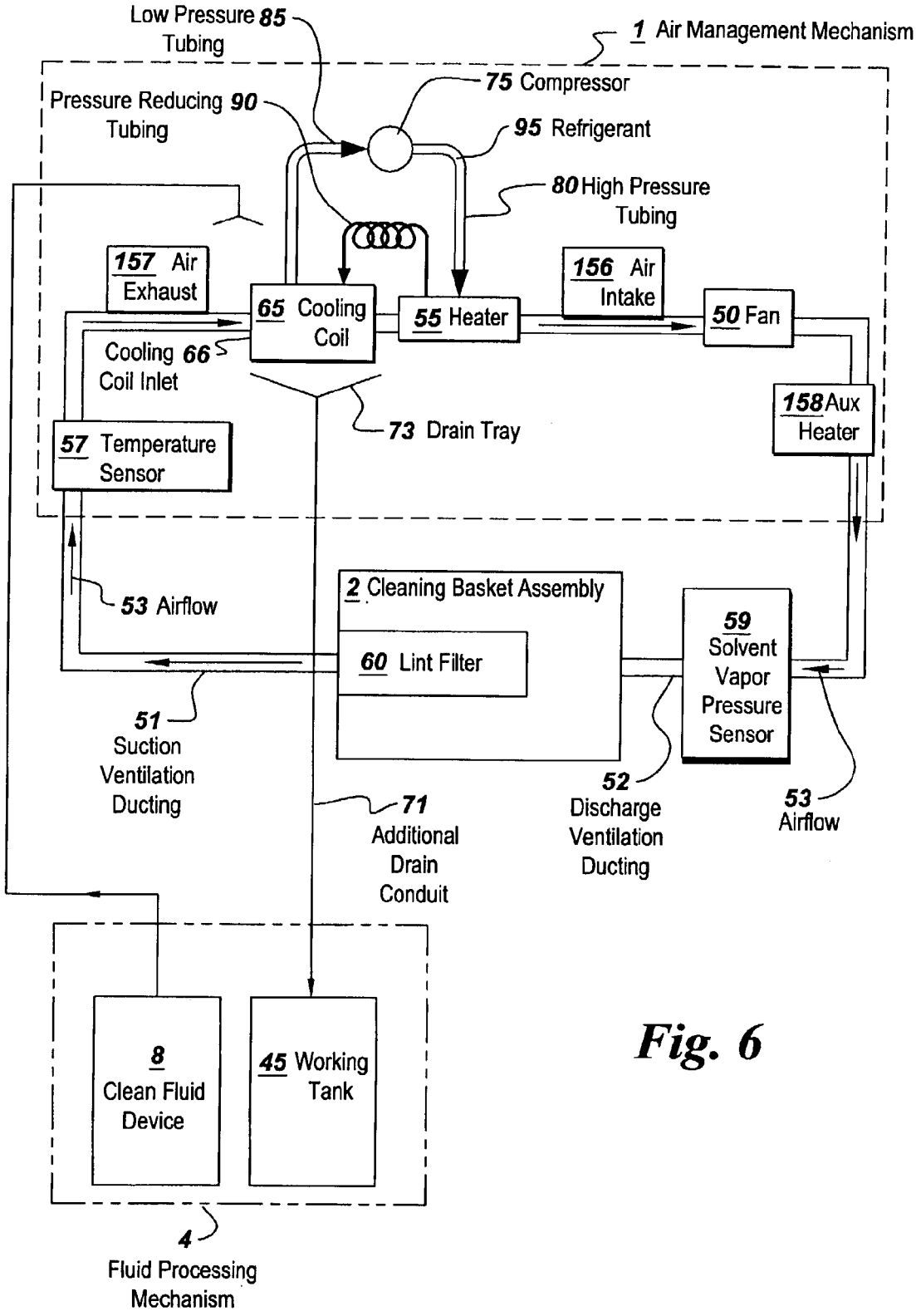
FIG. 6 is a schematic diagram of the air management mechanism and the cleaning basket assembly in accordance with another embodiment of the present invention.

A solvent vapor pressure sensor 59 detects the vapor pressure of the solvent based cleaning fluid 30 in the airflow 53 that circulates between the cleaning basket assembly 2 and the air management mechanism 1. The solvent vapor pressure sensor 59 is used to determine when solvent vapor pressure level reaches a predetermined level that indicates that the airflow 53 is no longer entraining substantial amounts of the solvent based cleaning fluid 30 of FIG. 2. The solvent vapor pressure sensor 59 of FIG. 6 is disposed in the discharge ventilation ducting 52. In another embodiment of the present invention, the solvent vapor pressure sensor 59 is typically disposed in the suction ventilation ducting 51, the discharge ventilation ducting 52, the cleaning basket assembly 2, and any combination thereof. In one embodiment of the present invention, the solvent vapor pressure sensor 59 replaces the temperature sensor 57.

The cooling coil 65 of FIG. 6 further comprises a cooling coil air inlet 66. In one embodiment of the present invention, one end of the cooling coil wash down tubing 160 is aimed at the cooling coil air inlet 66 of FIG. 6. The spray nozzle 67 and the pump 25 flushes away lint and debris that accumulates on the surface of the cooling coil air inlet 66 of FIG. 6 to maintain airflow 53 (i.e. decrease the pressure drop across the cooling coil 65) through the air management mechanism 1 and the cleaning basket assembly 2. In one embodiment of the present invention, spraying the solvent based cleaning fluid 30 of FIG. 2 at the cooling inlet 66 of FIG. 6 provides additional cooling and condensation of vapor in the airflow 53.

As shown in FIG. 6, in another embodiment of the present invention, the air management mechanism 1 further comprises a compressor 75, high-pressure tubing 80, low-pressure tubing 85 and pressure reducing tubing 90 are disposed in a vapor compression cycle. As used herein, the term, "high-pressure tubing" is used to indicate that the high-pressure tubing is designed to contain a refrigerant 95 at a higher pressure than the "low-pressure tubing". The use of the terms "high-pressure tubing" and "low-pressure tubing" are used to express a relative pressure differential across the compressor 75. As used herein, the term, "pressure reducing tubing" is defined to indicate that the "pressure reducing tubing" comprises a flow restriction that is sufficient to provide the relative pressure differential at a junction between the "high-pressure tubing" and the "low-pressure tubing". The high-pressure tubing 80 of FIG. 6 is disposed from the compressor 75 to the heater 55. The pressure reducing tubing 90 is disposed between the heater 55 and the cooling coil 65. The low-pressure tubing 85 is disposed from the compressor 75 to the cooling coil 65. The refrigerant 95 is disposed to flow between the compressor 75, heater 55, and cooling coil 65.

Figure 13:
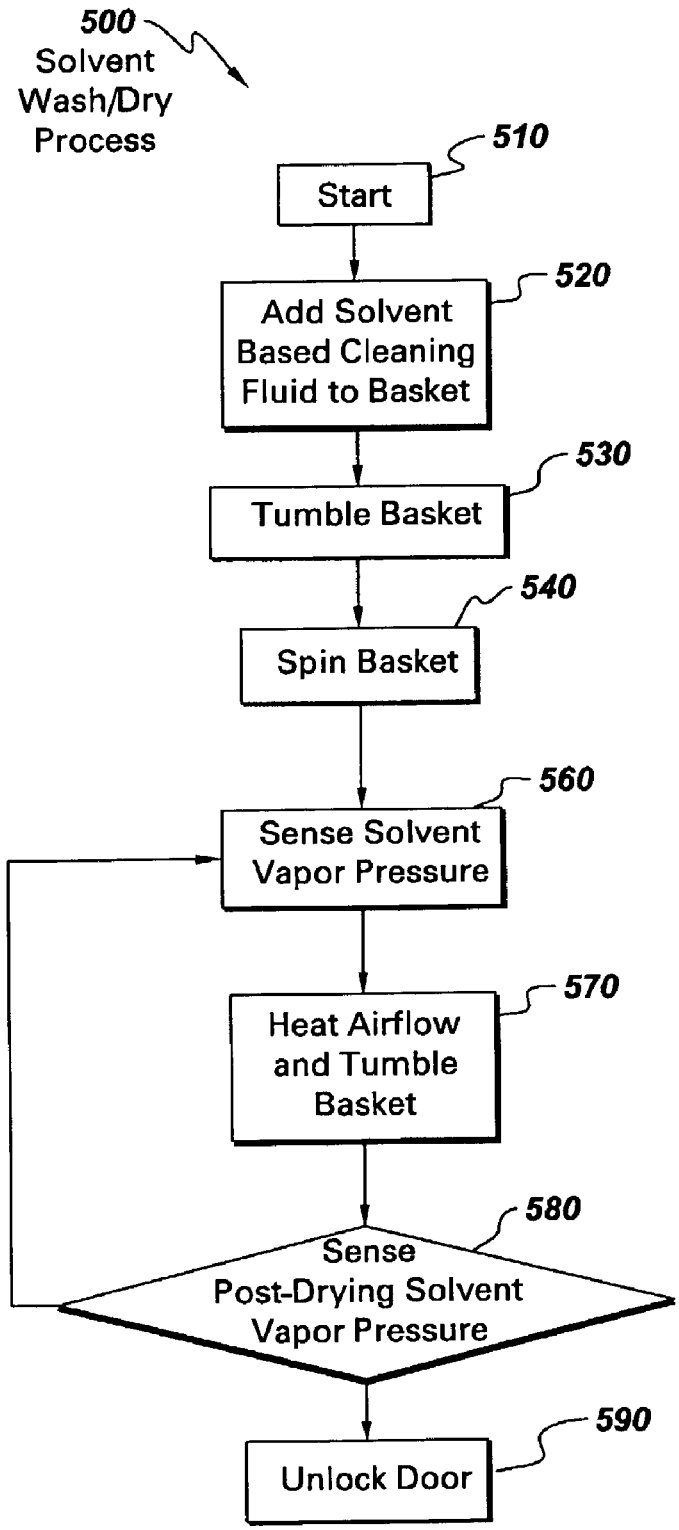
FIG. 13 is a flow diagram of a solvent cleaning process in accordance with one embodiment of the present invention.

The vapor compression cycle attains a higher coefficient of performance (COP) for solvent wash/dry process 500 of FIG. 13. The vapor compression cycle operating in a heat pump configuration reduces energy requirements for the solvent cleaning process 375 of FIG. 11. Energy is conserved as the refrigerant 95 of FIG. 6 passing through the cooling coil 65 adsorbs heat from the airflow 53 and then the refrigerant 95 rejects the heat back into the airflow 53 by passing through the heater 55. In one embodiment of the present invention, the refrigerant 95 is fluorocarbon R-22; however, other refrigerants known to one skilled in the refrigerant art would be acceptable. The heater 55 functions as a condenser (warming the air flow 53 through the heater 55), while the cooling coil 65 functions as an evaporator (cooling the air flow 53 through the cooling coil 65 and condensing any vapor).

In another embodiment of the present invention, the air management mechanism 1 further comprises an auxiliary heater 158 of FIG. 6. The fan 50 is further disposed to provide airflow 53 through the auxiliary heater 158. Typically, the auxiliary heater 158, used in conjunction with the heater 55, provides a higher temperature in the airflow 53 that enters the cleaning basket assembly 2. The auxiliary heater 158 is disposed in the discharge ventilation ducting 52. In another embodiment of present invention, the auxiliary heater 158 is disposed in the suction discharge ventilation ducting 53. Raising the air temperature of the airflow 53 typically decreases the drying time for the articles in the humidity sensing process 400 of FIG. 12 and the solvent wash/dry process 500 of FIG. 13.

The inputs to the controller 5 of FIG. 7 are typically selected from the group consisting of the door lock sensor 18, the temperature sensor 57, the solvent vapor pressure sensor 59, the optical sensor 140, the conductivity sensor 151, the basket conductivity cell 170, the basket level detector 172, the basket humidity sensor 173, the operator interface 190, the access door lock sensor 248, and any combination thereof. The outputs of the controller 5 are typically selected from the group consisting of the motor 3, the door lock 19, the pump 25, the fluid heater 28, the check valve 40, the fan 50, the heater 55, the spray nozzle 67, the compressor 75, the regeneration pump 115, the water separator 152, the waste water drain valve 155, the auxiliary heater 158, the mixing valve 185, the display panel 200, the access door lock 246, the water drain valve 260, and any combination thereof.

The controller 5 is further configured to perform a solvent based cleaning fluid recirculation process. In the solvent based cleaning fluid recirculation process, the solvent based cleaning fluid 30 passes through the fluid processing mechanism 4 and cleaning basket assembly 4 as discussed above for a predetermined amount of time. The solvent based cleaning fluid recirculation process is performed when the article cleaning apparatus 1000 is not engaged in either the cleaning process 350 of FIG. 11 or the drying process 360. In the case where the operator selects either the cleaning process 350 or the drying process 360 during the solvent based cleaning fluid recirculation process, the controller 5 recovers the article cleaning apparatus 1000 using a cycle interruption recovery process 800 of FIG. 16, which will be subsequently described in detail. As used herein, the term, "recovers the article cleaning apparatus," relates to placing the article cleaning apparatus 1000 in a condition to perform either the cleaning process 350 or the drying process 360.

Figure 8:
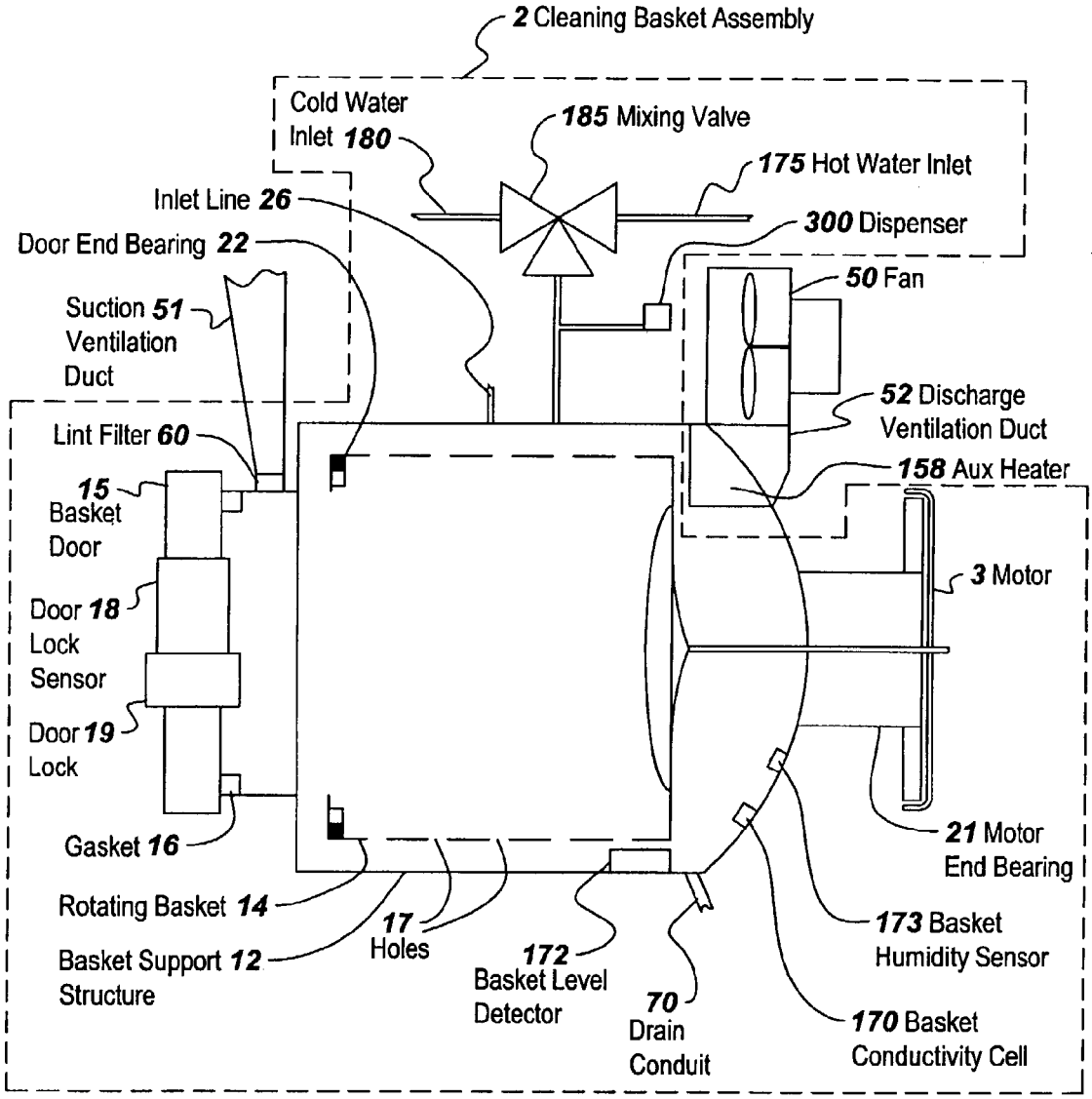
FIG. 8 is a schematic cross sectional view of the cleaning basket assembly in accordance with one embodiment of the present invention.

The cleaning basket assembly 2 of FIG. 8 depicts one embodiment of the present invention where a cleaning basket support structure 12 supports the rotating basket 14 through a door end bearing 22 and a motor end bearing 21. The motor 3 is disposed to the rotating basket 14 at the opposite end of the rotating basket where a basket door 15 is disposed. The cleaning basket assembly 2 further comprises a gasket 16, a door lock sensor 18, and a door lock 19. The basket support structure 12 further comprises a liquid drain connection to the drain conduit 70 and a solvent based cleaning fluid supply connection to the inlet tubing 26. The basket support structure 12 further comprises a connection to the discharge ventilation ducting 52 and a connection to the suction ventilation ducting 51. A lint filter 60 is typically situated in the suction ventilation ducting 51. The cleaning basket assembly 2 of FIG. 8 further comprises a basket humidity sensor 173 that has the capability to determine the humidity level in the rotating basket 14. In one embodiment of the present invention, the basket humidity sensor 173 is disposed inside the basket support structure 12 adjacent the rotating basket 14.

The air management mechanism 1 of FIG. 1, the cleaning basket assembly 2, fluid processing mechanism 4, and the controller 5 are disposed inside an enclosure 230 of FIG. 9, where only the cleaning basket assembly 2 is depicted in the cut away view of the enclosure 230. Additionally, the controller 5 of FIG. 7 is configured to receive input controls from the operator from an operator interface 190 of FIG. 9 and configured to provide a cleaning status at the display panel 200. The enclosure 230 further comprises an enclosure floor 250 that is substantially perpendicular to an enclosure rear wall 240. The rotating basket 14 has a longitudinal axis 220 that is about parallel to the enclosure floor 250. As used herein, the term, "about parallel" is defined to include a range from about −3 degrees to about +3 degrees from parallel. The enclosure 230 further comprises an enclosure front wall 242 that is on the side of the enclosure where the basket door 15 is disposed. In one embodiment of the present invention, the operator interface 190 and the display panel 200 are disposed on the enclosure front wall 242. The location of the operator interface 190 and the display panel 200 is provided by way of illustration and is not intended to imply a limitation to the present invention. In one embodiment of the present invention, the enclosure floor 250 is configured to act as a containment pan to collect leakage of the solvent based cleaning fluid 30. In another embodiment of the present invention, the enclosure 230 is configured to act as the containment pan to collect leakage of the solvent based cleaning fluid 30.

In one embodiment of the present invention, the enclosure 230 has an overall volumetric shape of about 0.7 meters in width, by about 0.9 meters in depth, by about 1.4 meters in height. This volumetric shape represents the typical space available in an in-home laundry setting.

The regeneration cartridge 141 of FIG. 2 is typically the one item in the fluid processing mechanism 4 requiring periodic replacement. In one embodiment of the present invention, the enclosure front wall 242 of FIG. 9 comprises an access door 244, an access door lock 246, and an access door lock sensor 248. The location of the access door 244, access door lock 246 and the access door lock sensor 248 is provided by way of illustration and is not intended to imply a limitation to the present invention. The access door lock 246 and access door lock sensor 248 are coupled to the controller 5 of FIG. 7. The controller logic in the controller 5 keeps the access door lock 246 locked during the cleaning process 350 of FIG. 11, the drying process 360, and the solvent based cleaning fluid recirculation process. The controller logic only permits replacing the regeneration cartridge 141 of FIG. 2 when the article cleaning apparatus 1000 is not operating any of the following: the cleaning process 350 of FIG. 11, the drying process 360 and the solvent based cleaning fluid recirculation process. When the controller logic verifies that any of the following: the cleaning process 350 of FIG. 11, the drying process 360, and the solvent based cleaning fluid recirculation process are not in progress, then the controller 5 of FIG. 7 unlocks the access door lock 246 in response to an operator request via the operator interface 190 to replace the regeneration cartridge 141. If an operator requests to replace the regeneration cartridge 141 and the article cleaning apparatus 1000 is operating any process, the operator is notified that the replacement of the regeneration cartridge 141 is not permitted via a notification message displayed on the display panel 200. By not permitting the cleaning process 350 of FIG. 11, the drying process 360, and the solvent based cleaning fluid recirculation process to be performed by the article cleaning apparatus 1000 of FIG. 2 during the regeneration cartridge 141 replacement, the operator is afforded protection from an inadvertent exposure to the solvent based cleaning fluid 30. Additionally, the controller logic does not allow the article cleaning apparatus 1000 to initiate any process until the access door lock sensor 248 of FIG. 9 verifies that the access door 244 is shut and the access door lock 246 is locked. The access door lock sensor 248 is additionally configured to detect that the regeneration cartridge 141 of FIG. 2 is properly installed before indicating that the access door 244 of FIG. 9 is properly closed and that the access door lock 246 is properly locked.

Additionally, in one embodiment of the present invention, the regeneration cartridge 141 of FIG. 2 further comprises a leak proof double inlet valves assembly 101 and a leak proof double outlet valves assembly 106 to minimize the operator's contact with the solvent based cleaning fluid 30. In another embodiment of the present invention, the regeneration cartridge 141 (not shown in FIG. 2) further comprises a leak proof single inlet valve assembly 100 and a leak proof single outlet valve assembly 105 to minimize the operator's contact with the solvent based cleaning fluid 30. As used herein, the term, "leak proof" is defined to mean that there is no leakage of the solvent based cleaning fluid 30 beyond about 1 ml evident at 1) either end of the regeneration cartridge 141 after removal and 2) the connection points where the regeneration cartridge 141 installs into the fluid regeneration device 7.

The controller logic in the controller 5 of FIG. 7 is designed to keep the basket door lock 19 locked shut while performing any of the following: the cleaning process 350, the drying process 360, and the solvent based cleaning fluid recirculation process. This limits the operator's ability to expose oneself to the solvent based cleaning fluid 30 during any of the following: the cleaning process 350, the drying process 360, and the solvent based cleaning fluid recirculation process thereby reducing the number of opportunities that the operator is exposed to the solvent based cleaning fluid 30.

In one embodiment of the present invention, the clean fluid device 8 of FIG. 2 further comprises a fluid heater 27 disposed between the pump 25 and the cleaning basket assembly 2 in the inlet line 26. The fluid heater 27 is coupled to the controller 5 of FIG. 7. The fluid heater 27 has the ability to increase the temperature of the solvent based cleaning fluid 30. The elevated temperature of the solvent based cleaning fluid 30 has the effect of improving the soil removal cleaning performance for some types of article and soiling combinations.

In another embodiment of the present invention the article cleaning apparatus 1000 of FIG. 1 is further configured to add a small quantity of water (in the range from about 1 percent to about 8 percent of the total weight of the solvent based cleaning fluid 30) and other cleaning agents to the rotating basket 14 to mix with the solvent based cleaning fluid 30 entering the cleaning basket assembly 2 through the inlet line 26. In one embodiment of the present invention, the cleaning basket assembly 2 of FIG. 8 further comprises a hot water inlet 175 and a cold-water inlet 180, both of which are coupled to a mixing valve 185. A basket conductivity cell 170 and a basket level detector 172 are disposed in the cleaning basket assembly 2, such that the basket conductivity cell 170 determines the conductivity of the fluid in the rotating basket 14 and the basket level detector 172 determines the level of the water based cleaning fluid 31 or the solvent based cleaning fluid 30 in the rotating basket 14. In one embodiment of the present invention, a dispenser 300 is disposed off a line that couples the mixing valve 185 to the basket support structure 12. Additionally, the operator adds the cleaning agents to the dispenser 300 and the subsequent action of the water running through the line coupling the mixing valve 185 to the basket support structure 12 entrains the cleaning agents that are disposed in the dispenser 300 into the water entering the rotating basket 14.

Figure 14:
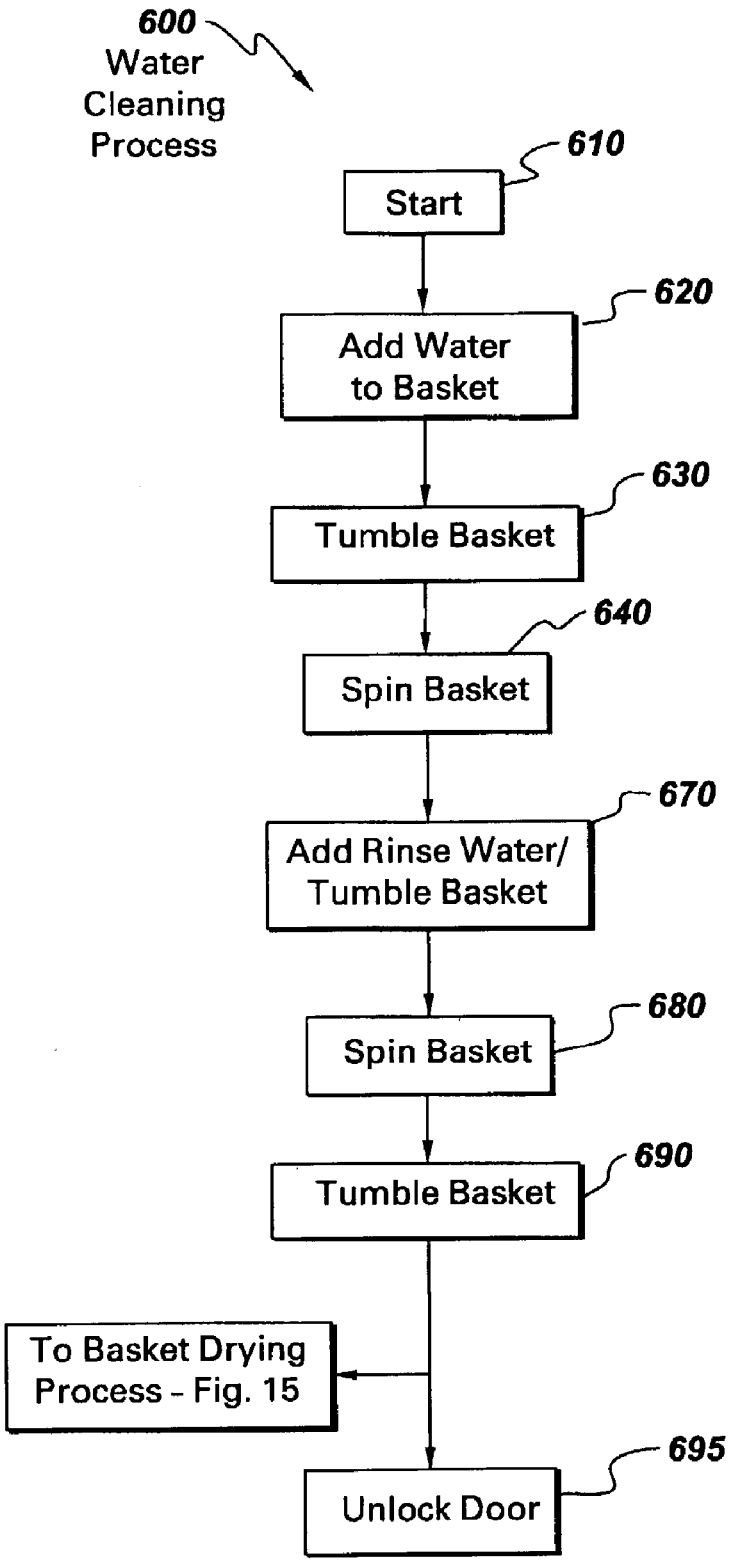
FIG. 14 is a flow diagram of a water cleaning process in accordance with one embodiment of the present invention.

In one embodiment of the present invention, the article cleaning apparatus 1000 of FIG. 1 is further configured to perform the water cleaning process 600 of FIG. 14 utilizing a water based cleaning fluid 31. In addition to the above-discussed components associated with monitoring and adding water to the rotating basket 14, a water drain line 270 connects to the drain conduit 70 upstream of the check valve 40. The water drain line 270 also connects to the suction side of the regeneration pump 115. A water drain valve 260 is disposed in the water drain line 270. The method of adding cleaning agents to the water in the rotating basket 14 is the same as discussed above.

Figure 10:
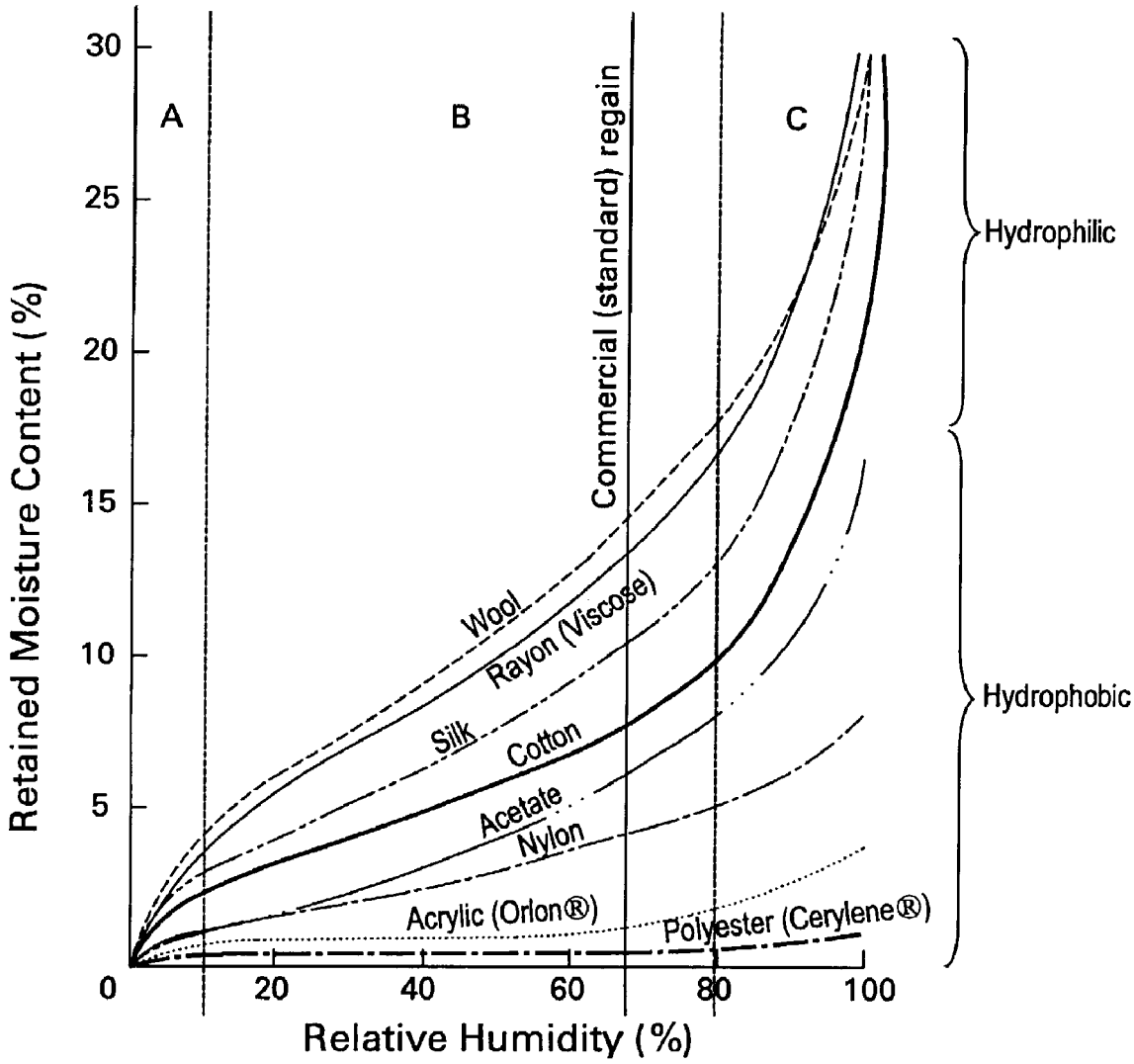
FIG. 10 is a plot of retained moisture content as a percentage of an article's weight versus the relative humidity.

A plot of retained moisture content as a percentage of an article's weight versus the relative humidity is provided in FIG. 10 for a variety of materials that are commonly used to comprise articles. As the fluid processing mechanism 4 of FIG. 2 contains a finite quantity of water removal capability, the controller 5 of FIG. 7 is configured to reduce the amount of water admitted to the fluid processing mechanism 4 of FIG. 2. The reduction of the retained moisture content is accomplished in a humidity sensing process 400 of FIG. 11 that is part of the solvent cleaning process 375.

Figure 11:
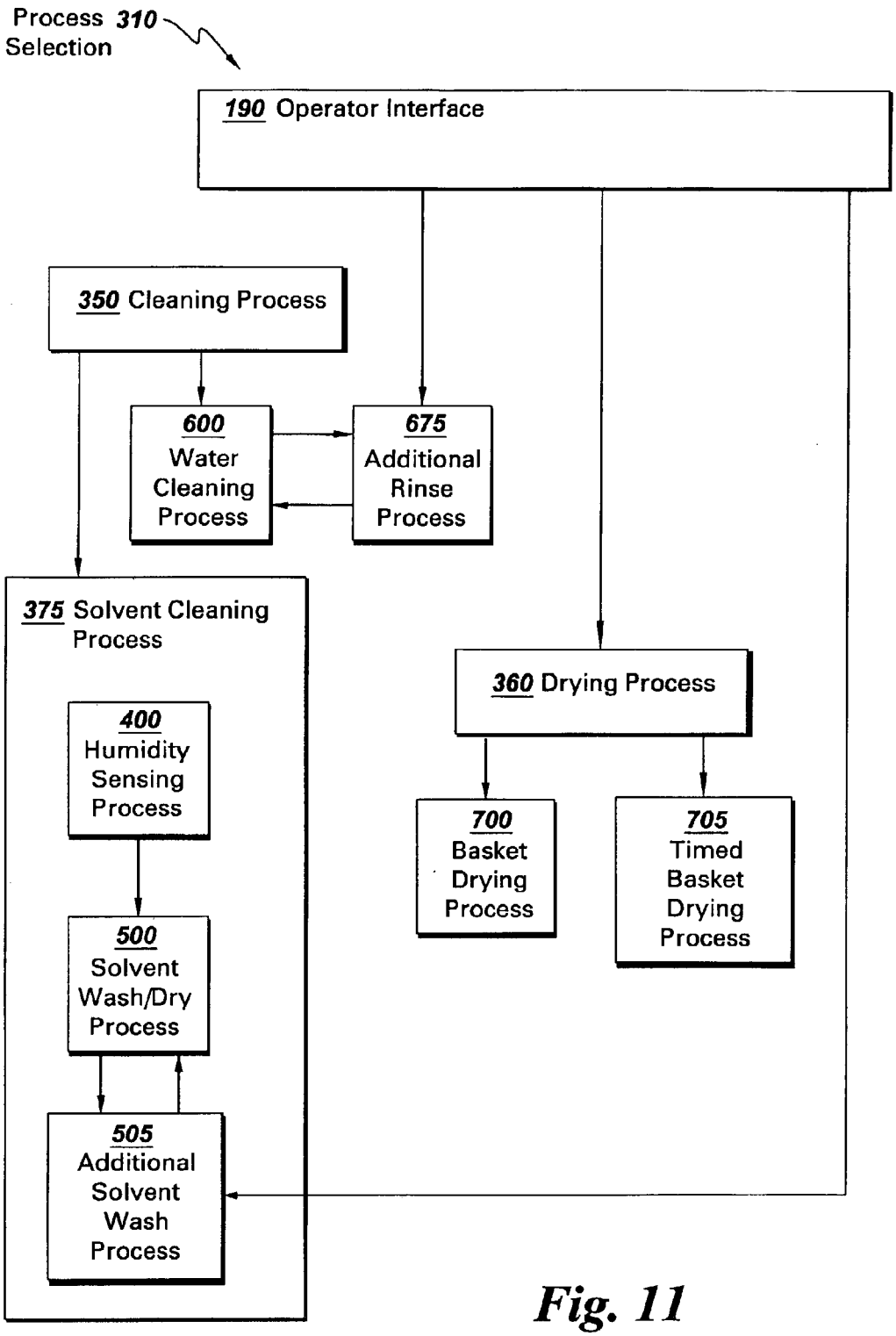
FIG. 11 is a block diagram of the process selection in accordance with one embodiment of the present invention.

In one embodiment of the present invention, a process selection 310 of FIG. 11 occurs at the operator interface 190 and provides inputs to the controller 5 of FIG. 7. The operator selects between the cleaning process 350 of FIG. 11 and a drying process 360. As used herein, the term, "drying process" refers to the drying of articles after completing the water based cleaning 600 of FIG. 14. When the operator selects the cleaning process 350 of FIG. 11, the operator then further chooses between performing either the solvent cleaning process 375 or the water cleaning process 600. In the present invention, the solvent cleaning process 375 of FIG. 11 is defined to include performing the humidity sensing process 400 and the subsequent solvent wash/dry process 500. Conversely, when the operator selects the drying process 360, a basket drying process 700 is performed. In one embodiment of the present invention, the operator has the option to select an additional solvent wash process as part of the solvent wash/dry process 500. The additional solvent wash process is typically used in conjunction with utilizing the solvent based cleaning fluid 30 that comprises cleaning agents. The additional solvent wash process typically improves the removal of the cleaning agents from the articles that remain after initially completing step 540 as detailed below. In another embodiment of the present invention, the operator has the option to select an additional rinse process as part of the water cleaning process 600. In another embodiment of the present invention, when the operator selects the drying process 360 the operator is provided with a further option of selecting from either the basket drying process 700 or a timed basket drying process 705.

Figure 12:
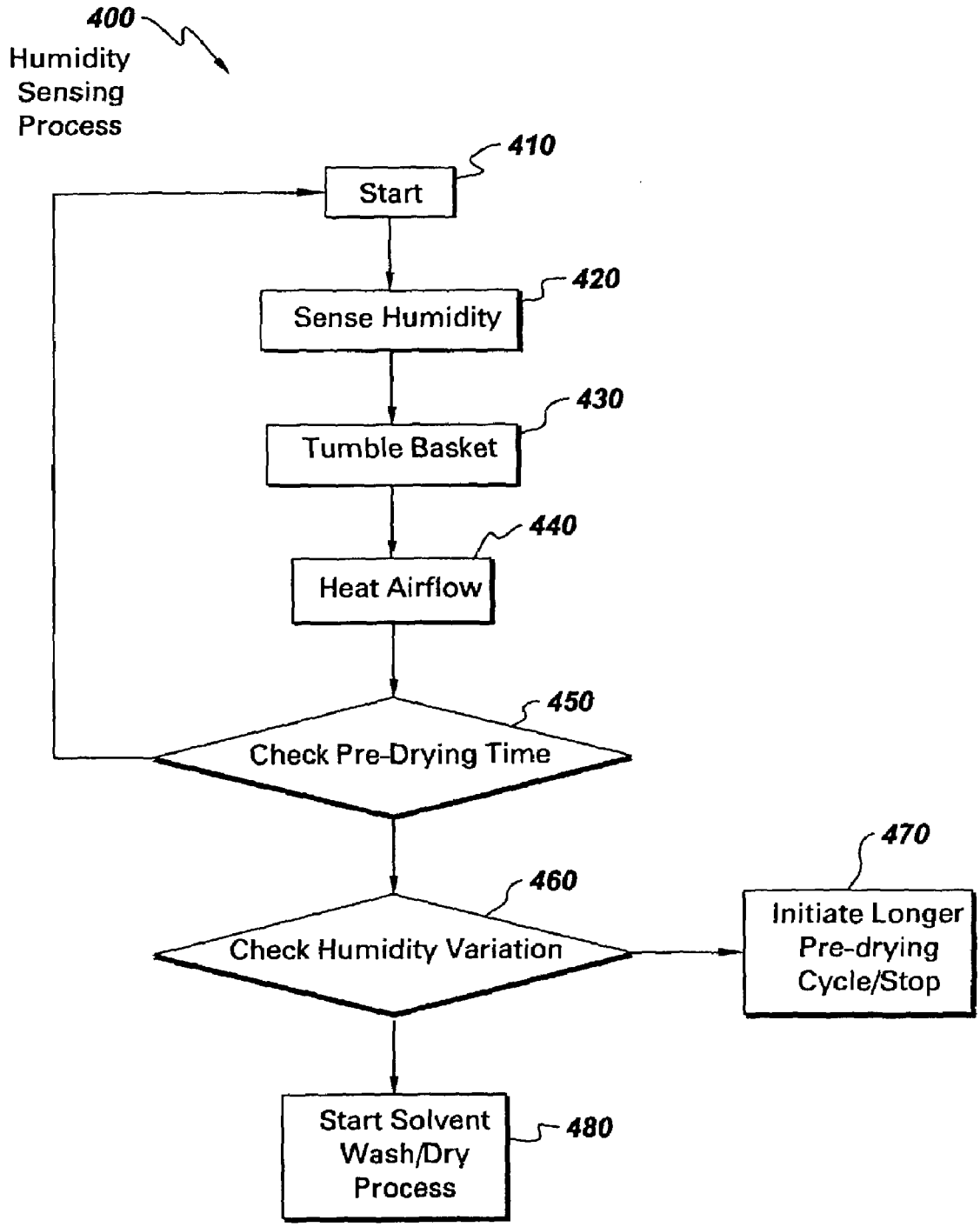
FIG. 12 is a flow diagram of a humidity sensing process in accordance with one embodiment of the present invention.

The start of the solvent based cleaning cycle 375 of FIG. 11 starts with the controller 5 of FIG. 7 sensing the humidity in the rotating basket 14 of FIG. 8 by initiating the humidity sensing process 400 of FIG. 12. The start 410 of the humidity sensing process 400 initially begins by verifying that the door lock 19 is locked. A starting humidity in the rotating basket 14 of FIG. 8 is determined in the sensing humidity step 410 of FIG. 12 by the basket humidity sensor 173. The controller 5 of FIG. 7 then tumbles the rotating basket 14 in step 430 of FIG. 12. The airflow 53 of FIG. 5 is heated and passed through the air management mechanism 1 and the cleaning basket assembly 2 while tumbling the rotating basket 14 for a predetermined pre-drying time in step 440 of FIG. 12. The moisture in the rotating basket 14 becomes vapor. The airflow 53 containing the vapor comes out of the rotating basket 14 through the holes 17 of FIG. 8 and then passes through the lint filter 60. The airflow 53 of FIG. 5 subsequently passes over the cooling coil 65 where the vapor condenses to form condensate. The rotating basket 14 is tumbled and the airflow 53 entering the cleaning basket assembly 2 is heated for the predetermined amount of time. The controller 5 of FIG. 7 then determines a finishing humidity in the rotating basket 14 of FIG. 8. If the controller 5 of FIG. 7 determines that the finishing humidity is too high, then the controller 5 of FIG. 7 sends a warning in step 470 of FIG. 12 to the operator at the display panel 200 indicating that it may take longer to complete the solvent cleaning process 375 and a longer humidity sensing process 400 is initiated.

After completing the humidity sensing process 400, the solvent wash/dry process 500 of FIG. 13 is typically executed. The following typical solvent wash/dry process 500 of FIG. 13 is utilized in one embodiment of the present invention. The following steps of the solvent wash/dry process 500 are provided for illustration and in no way implies any restriction to the present invention. The initial conditions at the start step 510 include reverifying that the door lock 19 of FIG. 8 is locked. The solvent based cleaning fluid 30 of FIG. 2 is added to the rotating basket 14 of FIG. 8 as depicted in step 520 of FIG. 13 and as described in detail above. The rotating basket 14 of FIG. 8 is then tumbled as shown in step 530 of FIG. 13. After tumbling for a predetermined amount of time, the controller 5 of FIG. 7 opens the check valve 40, and the solvent based cleaning fluid 30 of FIG. 2 starts to drain from the rotating basket 14 of FIG. 8. Substantially all of the remaining portion of the solvent based cleaning fluid 30 of FIG. 2 is spin extracted by spinning the rotating basket 14 in step 540 of FIG. 13. The solvent based cleaning fluid 30 is drained to the working tank 45 and subsequently the controller 5 of FIG. 7 shuts the check valve 40 of FIG. 2.

The solvent vapor pressure in the rotating basket 14 of FIG. 8 is determined in step 560 of FIG. 13. The controller 5 of FIG. 7 then tumbles the rotating basket 14 and raises the temperature of the airflow 53 of FIG. 5 in step 570 of FIG. 13. A substantial amount of the remaining portion of the solvent based cleaning fluid 30 and any liquid becomes vapor. The vapor flows from the rotating basket 14 through the lint filter 60 and passes over the cooling coil 65. The vapor condenses on the cooling coil 65 to form a condensate. The post-drying solvent vapor pressure in the rotating basket 14 of FIG. 8 is determined in step 580 of FIG. 13. The process steps of 560 through 580 FIG. 13 as detailed above are performed until the post-drying solvent vapor pressure in the rotating basket 14 of FIG. 8 reaches an acceptable level, at which point the controller 5 of FIG. 7 unlocks the basket door 15 in step 590 of FIG. 13. In another embodiment of the present invention, the operator selects the additional solvent wash process. The additional solvent wash process comprises completing step 520, step 530, and step 540 occurs after completing step 540 and before performing step 560, where the individual steps are as described above. In one embodiment of the present invention, the additional solvent wash process enhances the cleaning performance of especially soiled articles. In another embodiment of the present invention, the additional solvent wash process enhances the removal of cleaning agents. The operator selects the additional solvent wash process at the operator interface 190.

In one embodiment of the present invention the rotating basket 14 of FIG. 8 has a typical load range between about 0.9 kg and about 6.8 kg. The rotating basket 14 has a rotating basket capacity with a typical range between about 17 liters and about 133 liters, which is generally useful for performing laundering utilizing the solvent based cleaning fluid 30 of FIG. 2. The ratio of liters of solvent based cleaning fluid 30 per kg of articles in the laundry load is generally in a range from about 4.2 liters/kg to about 12.5 liters/kg. The corresponding total capacity of the solvent based cleaning fluid 30 per laundry load is generally in a range from about 3.8 liters (4.2 liters/kg times 0.9 kg) to about 85 liters (12.5 liters/kg times 6.8 kg), respectively. The total amount of solvent based cleaning fluid 30 in the article cleaning apparatus 1000 of FIG. 1 is from about 1.05 to about 2.0 times the amount of solvent based cleaning fluid 30 of FIG. 2 required per load. The total amount of solvent based cleaning fluid 30 equates to a range from about 4 liters (3.8 liters times 1.05) to about 170 liters (85 liters times 2), which corresponds to a typical ratio of the capacity of the solvent based cleaning fluid 30 to laundry load ranges from about 4.4 liters/kg (4 liters/0.9 kg) to about 25 liters/kg (170 liters/6.8 kg), respectively.

In another embodiment, the typical amount of articles in a laundry load range from about 2.7 kg to about 5.4 kg. The corresponding total capacity of the solvent based cleaning fluid 30 per laundry load is generally in a range from about 11.3 liters (4.2 liters/kg times 2.7 kg) to about 67.5 liters (12.5 liters/kg times 5.4 kg). The total amount of solvent based cleaning fluid 30 in the article cleaning apparatus 1000 of FIG. 1 is from about 1.05 to about 2.0 times the amount of solvent based cleaning fluid 30 of FIG. 2 required per load. The total amount of solvent based cleaning fluid 30 equates to a range from about 11.9 liters (11.3 liters times 1.05) to about 135 liters (67.5 liters times 2).

In another embodiment, the ratio of liters of solvent based cleaning fluid 30 of FIG. 2 to kg of articles is from about 6.7 liters/kg to about 8.3 liters/kg. When the load capacity is in a range from about 0.9 kg to about 6.8 kg, the corresponding total capacity of the solvent based cleaning fluid 30 per laundry load is generally in a range from about 6.0 liters (6.7 liters/kg times 0.9 kg) to about 56.4 liters (8.3 liters/kg times 6.8 kg), respectively. When the load capacity is in a range from about 2.7 kg to about 5.4 kg, the corresponding total capacity of the solvent based cleaning fluid 30 per laundry load is generally in a range from about 18.1 liters (6.7 liters/kg times 2.7 kg) to about 44.8 liters (8.3 liters/kg times 5.4 kg), respectively. The total amount of solvent based cleaning fluid 30 in the article cleaning apparatus 1000 of FIG. 1 is from about 1.05 to about 2.0 times the amount of solvent based cleaning fluid 30 of FIG. 2 required per load. The total amount of solvent based cleaning fluid 30 equates to a range from about 6.3 liters (6.0 liters times 1.05) to about 112.8 liters (56.4 liters times 2).

In order to reduce the total capacity of the solvent based cleaning fluid 30 in the article cleaning apparatus 1000 of FIG. 1, the cleaning fluid processing is performed on-line and the processing is synchronized with the solvent wash/dry process 500 of FIG. 13. Processing the solvent based cleaning fluid 30 of FIG. 2 on-line typically provides sufficient solvent based cleaning fluid 30 in the storage tank 35 to perform a subsequent solvent cleaning process 350 of FIG. 11 after completing the previous solvent cleaning process 350. The storage tank 35 of FIG. 2 typically has a sufficient capacity of the solvent based cleaning fluid 30 to make up for any solvent based cleaning fluid 30 that is held up in the fluid regeneration device 7, in the working fluid device 6, and retention in the "dried" articles. The regeneration cartridge 141 is capable of replenishing the amount of solvent based cleaning fluid 30 that is retained in the "dried" articles. In one embodiment of the present invention, the typical solvent capacity of the storage tank 35 is from about 10.4 liters/kg to about 12.5 liters/kg when the load capacity ranges from about 2.7 kg to about 5.4 kg. The storage tank 35 has a corresponding typical range from about 28.1 liters to about 67.5 liters. Therefore, the storage tank 35 of the present invention typically needs only about 36% (67.5 liter/190 liter) of the capacity of the about 190 liter storage tank found in typical commercial chemical fluid dry cleaning machines. In one embodiment of the present invention, the typical solvent capacity of the storage tank 35 is from about 10.4 liters/kg to about 12.5 liters/kg when the load capacity ranges from about 0.9 kg to about 6.8 kg. The storage tank 35 has a corresponding typical range from about 9.4 liters to about 85 liters. Therefore, the storage tank 35 of the present invention typically needs only about 45% (85 liter/190 liter) of the capacity of the about 190 liter storage tank found in typical commercial chemical fluid dry cleaning machines. The above comparison of storage tank capacity typical range from about 9.4 liters to about 85 liters for the present invention compares favorably to the range of the storage tank capacity of from about 190 liters to about 1325 liters for typical commercial chemical fluid dry cleaning machines.

In another embodiment of the present invention, the solvent wash/dry process 500 adds water to the solvent based cleaning fluid 30 of FIG. 2 in the rotating basket 14, where the maximum amount of water added is in the range from about 1 percent to about 8 percent of the total weight of the solvent based cleaning fluid 30 that is in the rotating basket 14. Adding the water to the solvent based cleaning fluid 30 that is in the rotating basket 14 is performed as described above. In another embodiment of the present invention, the solvent wash/dry process 500 adds water and cleaning agents to the solvent based cleaning fluid 30 of FIG. 2 in the rotating basket 14, where the maximum amount of water added does not exceed a maximum of about 8 percent of the total weight of the solvent based cleaning fluid 30 that is in the rotating basket 14. Adding the water and the cleaning agents to the solvent based cleaning fluid 30 that is in the rotating basket 14 is performed as described above.

Steps 560 of FIG. 13 through 580 in the solvent wash/dry process 500 require a typical range from about 15 minutes to about 60 minutes for the typical laundry load, which ranges from about 0.9 kg of articles to about 6.8 kg of articles. The sensible heat required to dry the clothes, which is the principle source of total electrical power the machine requires, is in a range between about 430 watts to about 6300 watts. As used herein, the term, "sensible heat" is defined to be the total amount of heat added by the combination of the heater 55 and auxiliary heater 158 (if installed). In another embodiment, the drying time is between about 20 and about 60 minutes with the typical laundry load range between about 2.7 kg of articles and about 5.4 kg of articles. In this case, the sensible heat required to dry the clothes is in a range between about 1300 watts and about 5200 watts. In each of these cases, the power is easily handled on a household circuit with a maximum voltage of about 240V and a maximum amp rating of about 30 amps. In some embodiments, the article cleaning apparatus 1000 of FIG. 1 is configured to run on about 220V service in an about 20-amp circuit, about 220V service in an about 30-amp circuit, and about 110V service and in a circuit having a amperage range from about 15 amps to about 20 amps. All of these circuit types are typically available in homes for currently available cooking and drying appliances; therefore, presenting no additional installation difficulties.

The controller 5 of FIG. 7 controls the water cleaning process 600 of FIG. 14. The controller 5 of FIG. 7 is configured to reduce the opportunity for introducing large amounts of water into the working tank 45 of FIG. 2 as discussed herein. In the present invention, a fluid in the rotating basket 14 is defined to contain a "large amount of water" when the fluid comprises greater than about 10% water by weight. The water cleaning process 600 of FIG. 14 is provided to illustrate a series of steps used in one embodiment of the present invention and in no way implies any limitation to the water cleaning process 600 utilized in the present invention.

The water cleaning process 600 begins with the initial conditions of the cleaning agents loaded into the dispenser 300, and the door lock 19 engaged and the door lock sensor 18 verifying that the basket door 15 in the locked position at the start step 610 of FIG. 14. Water and cleaning agents are added to the rotating basket 14 to produce the water based cleaning fluid 31 of FIG. 9 in step 620. The water may be hot, cold or a mixture as detailed above. The rotating basket 14 is tumbled in step 630 of FIG. 14. Substantially all of the water based cleaning fluid 31 of FIG. 9 is spin extracted by rotating from the rotating basket 14 of FIG. 2 in step 640 of FIG. 14. The controller 5 of FIG. 7 opens the water drain valve 260 of FIG. 2 and operates the regeneration pump 115 as necessary to drain the rotating basket 14 during the spin step 640, when the basket conductivity cell 170 of FIG. 8 detects that the water based cleaning fluid 31 of FIG. 9 in the rotating basket 14 comprises greater than about 10% water by weight. The controller 5 of FIG. 7 closes the water drain valve 260 of FIG. 2 after removing the water based cleaning fluid 31 of FIG. 9 from the rotating basket 14 of FIG. 2 after completing the spin basket step 640.

Rinse water is then added to the rotating basket 14 of FIG. 8 and the rotating basket 14 is tumbled in step 670 of FIG. 14. The temperature of the rinse water is determined by the controller 5 of FIG. 7 in conjunction with the mixing valve 185 of FIG. 8. Substantially all of the remaining amount of rinse water is spin extracted by spinning the rotating basket 14 in step 680 of FIG. 14. The rinse water is removed as described above. The rotating basket 14 is tumbled in step 690 of FIG. 14. The basket door 15 of FIG. 8 is then unlocked in step 695 of FIG. 14.

In another embodiment of the present invention, the operator selects an additional rinse process. The additional rinse process reperforms step 670, step 680, and step 690. The additional rinse process occurs after step 690 and before the basket door 15 is unlocked in step 695. The additional rinse process assists in removing the entrained cleaning agents that are not removed during steps 670, 680, and 690. The additional rinse process is especially useful when using soft water. As used herein, the term "soft water" is defined as comprising less than about 10 grains of hardness per about 3.8 liters of water.

Figure 15:
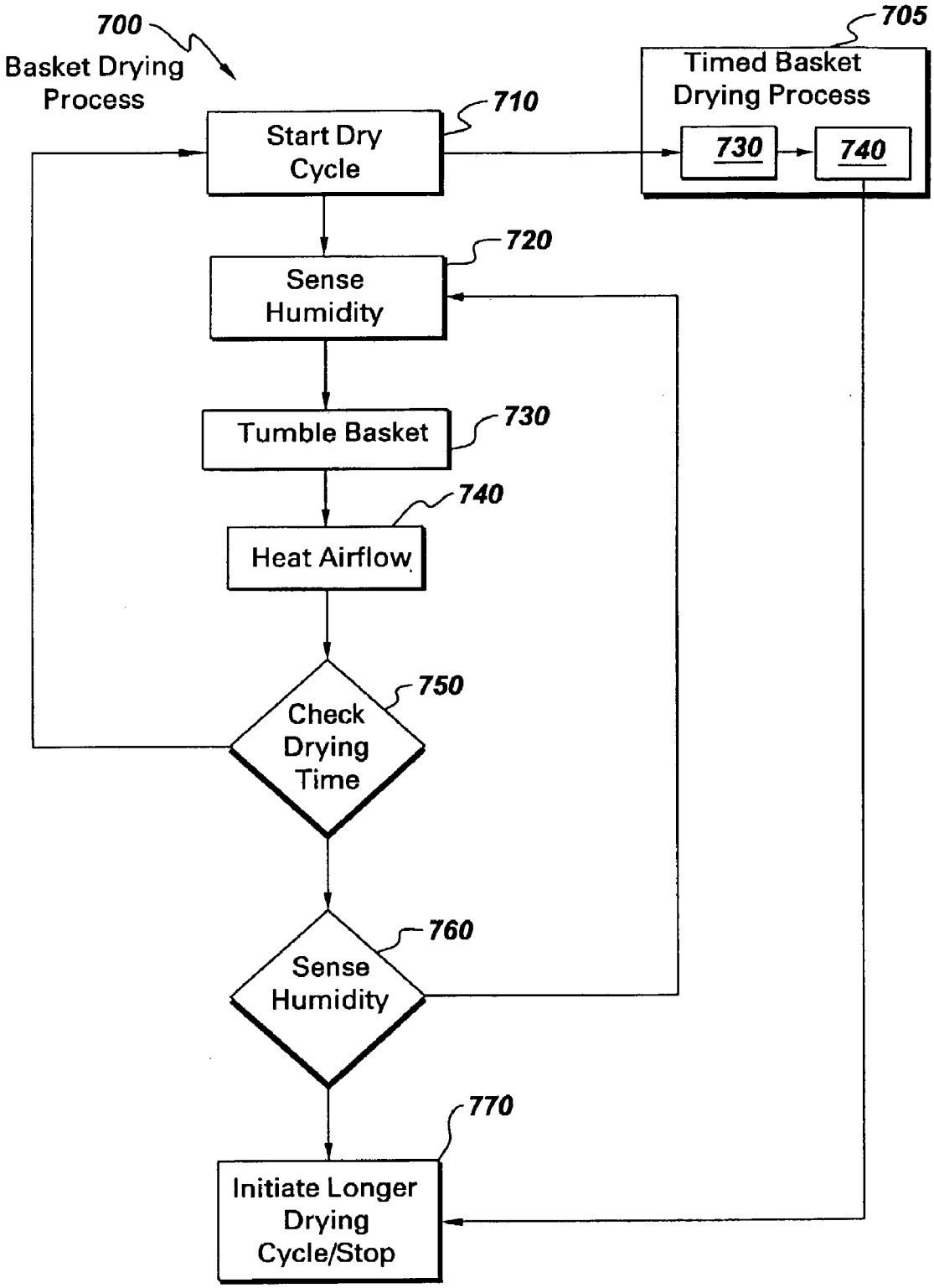
FIG. 15 is a flow diagram of a basket drying process in accordance with one embodiment of the present invention.

In another embodiment of the present invention, the article cleaning apparatus 1000 of FIG. 1 is configured to perform the basket drying process 700 of FIG. 15. The basket drying process 700 of FIG. 15 is provided to illustrate the basket drying process 700 used in one embodiment of the present invention and in no way implies any limitation to the basket drying process 700 of the present invention. The basket drying process 700 begins with the initial conditions of the basket door 15 locked, and the door lock sensor 18 verifying the basket door 15 locked at the start step 710 of FIG. 15. The basket drying process 700 initially begins by performing a sensing humidity step 720 to determine a start humidity, a tumble basket step 730 and heat airflow step 740 similar to that described above in steps 420, 430, and 440, respectively. After tumbling and heating the airflow 53 for a predetermined post-water wash drying time, the controller 5 of FIG. 7 determines a final humidity in the rotating basket 14 of FIG. 8 in step 760. When the controller 5 of FIG. 7 determines that the final humidity is too high, then the controller 5 initiates a longer drying sequence in step 760 by re-performing steps 730 through 760. When the final humidity is acceptable, the controller 5 of FIG. 7 stops the basket drying process 700 of FIG. 15 in step 770, and unlocks the basket door 15 of FIG. 8 in step 780 of FIG. 15.

In another embodiment of the present invention, a timed basket drying process 705 of FIG. 11 is available to the operator at the operator interface 190. The timed basket drying process 705 comprises the steps of starting the drying cycle 710 of FIG. 15 by setting the predetermined amount of drying time, tumbling the rotating basket 14 in step 730, heating the airflow 53 in step 740, and stopping the timed basket drying process in step 770 when predetermined amount of drying time is accomplished. The controller 5 of FIG. 7 unlocks the basket door 15 of FIG. 8 in step 780 of FIG. 15.

It is important that a large amount of the water is not inadvertently directed to the working tank 45 of FIG. 2 during the solvent wash/dry process 500 of FIG. 13 that adds water, in the range from about 1 percent to about 8 percent, to the solvent based cleaning fluid 30 of FIG. 2 in the rotating basket 14 as discussed above. It is also important to reduce the possibility that the solvent based cleaning fluid 30 is not accidentally pumped out of the article cleaning apparatus 1000 of FIG. 1. If the solvent cleaning process 375 of FIG. 11 or the water cleaning process 600 is interrupted by either the operator or a loss of electrical power, the controller 5 of FIG. 7 utilizes a cycle interruption recovery process 800 of FIG. 16. The cycle interruption recovery process 800 operates a series of logical sequence options to control the subsequent operation of the article cleaning apparatus 1000 of FIG. 1. The logical sequence options include completing the appropriate cleaning cycle, completing a fail-safe process, or informing the operator to call service.

Figure 16:
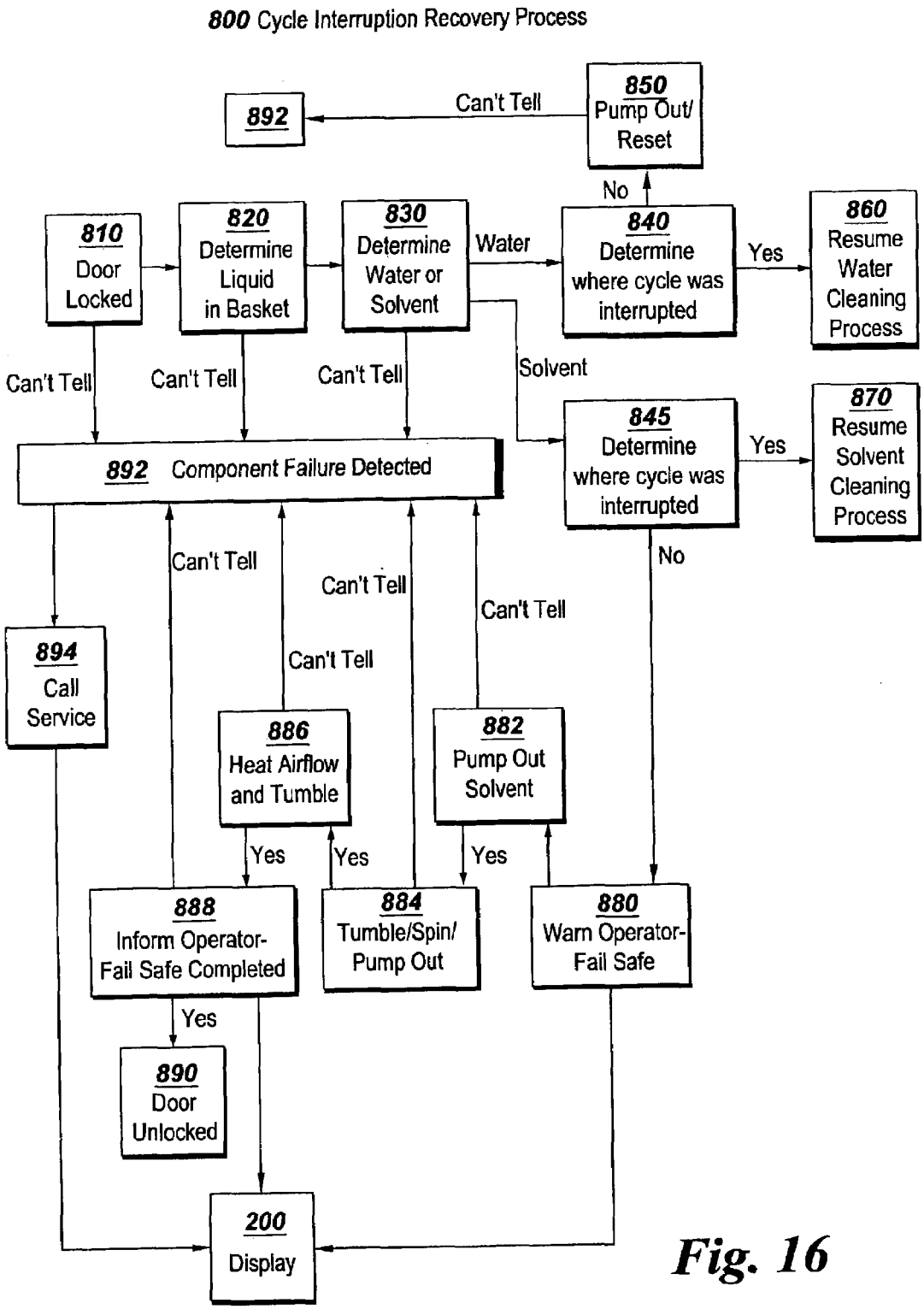
FIG. 16 is a flow diagram of a cycle interruption recovery process in accordance with one embodiment of the present invention.

In one embodiment of the present invention, the cycle interruption recovery process 800 starts by verifying the locked status of door lock 19 of FIG. 8 via the door lock sensor 18 in step 810 of FIG. 16. If the door lock sensor 18 of FIG. 8 is determined to be non-operational in the component failure detected step 892 of FIG. 16, then a call service message is generated in step 894, which is then sent to the display 200. Conversely, if the controller 5 of FIG. 7 does verify that the door lock 19 of FIG. 8 is locked in step 810 of FIG. 16, then the basket level detector 172 of FIG. 8 determines if there is liquid in the rotating basket 14 in step 820 of FIG. 16. If the controller 5 cannot tell if the basket level detector 172 is operational, then the component failure detected step 892 of FIG. 16 generates the call service message in step 894. If liquid is detected in step 820 of FIG. 16 then the basket conductivity cell 170 of FIG. 8 determines whether the liquid is the solvent based cleaning fluid 30 or the water based cleaning fluid 31 in step 830 of FIG. 16. Siloxane is non-conductive; therefore, the basket conductivity cell 170 of FIG. 8 typically provides a conductivity measurement of the liquid in the article cleaning apparatus 1000. If the controller 5 cannot tell if the basket conductivity cell 170 of FIG. 8 is operational, then the component failure detected step 892 of FIG. 16 generates a call service message in step 894.

If the basket conductivity cell 170 of FIG. 8 detects that the fluid in the rotating basket 14 comprises greater than about 10% water, then the fluid is defined to be the water based cleaning fluid 31. If the fluid in the rotating basket 14 is defined to be the water based cleaning fluid 31, then a determination of where the interruption occurred in the water cleaning process 600 is performed in step 840. In step 840, if the controller 5 of FIG. 7 has a memory of where the water cleaning process interruption occurred, then the water cleaning process 600 resumes as depicted in step 860. If the controller 5 in step 840 of FIG. 16 cannot remember where the water cleaning process interruption occurred, then the water based cleaning fluid 31 is pumped out and the cleaning process 350 of FIG. 11 is reset in step 850 of FIG. 16. If the controller 5 in step 850 of FIG. 16 cannot tell if the components required to perform step 850 are available, then the component failure detected step 892 generates the call service message in step 894.

If the basket conductivity cell 170 of FIG. 8 detects less than about 10% water in the liquid in the rotating basket 14, then the liquid is defined to be the solvent based cleaning fluid 30. If the liquid is defined to be the solvent based cleaning fluid 30, then a determination of where the interruption occurred in the solvent cleaning process 375 is performed in step 845. In step 845, if the controller 5 of FIG. 7 has a memory of where the solvent cleaning process interruption occurred, then the solvent cleaning process 375 resumes as depicted in step 870. If the controller 5 of FIG. 7 in step 845 of FIG. 16 cannot determine where the interruption occurred in the solvent cleaning process 375 of FIG. 11, then a warn operator fail-safe message is generated in step 880, which is then set to the display 200 of FIG. 9.

After generating the warn operator fail-safe message in step 880 of FIG. 16, the solvent based cleaning fluid 30 of FIG. 2 is pumped out in step 882 of FIG. 16. Subsequently the rotating basket 14 of FIG. 8 is tumbled and rotated to spin extract substantially all of the remaining portion of the solvent based cleaning fluid 30 of FIG. 2 from the rotating basket 14 in step 884 of FIG. 16. The airflow 53 is then heated while tumbling the rotating basket 14 of FIG. 8 in step 886 of FIG. 16. The operator is informed that the fail-safe is completed in step 888, and the fail-safe completed message is sent to the display 200 of FIG. 9, and the basket door 15 of FIG. 8 is unlocked in step 890 of FIG. 16. If it is determined that the components required to operate each of the steps 882, 884, 886, and 888 are non-operational, then the component failure detected step 892 of FIG. 16 generates the call service message in step 894.

The cycle interruption recovery process 800 of FIG. 16 is provided to illustrate the cycle interruption recovery process 800 used in one embodiment of the present invention and in no way implies that any limitation to the cycle interruption recovery process 800 employed in controlling operation of article cleaning apparatus 1000 of FIG. 1 of the present invention.

The foregoing description of several embodiments of the article cleaning apparatus 1000 and the method of using the article cleaning apparatus 1000 of the present invention has been presented for purposes of illustration. Although the invention has been described and illustrated in detail, it is to be clearly understood that the same is intended by way of illustration and example only and is not to be taken by way of limitation. Obviously many modifications and variations of the present invention are possible in light of the above teaching. Accordingly, the spirit and scope of the present invention are to be limited only by the terms of the appended claims.

What is claimed:

1. A method for recovering and purifying a solvent used in an article cleaning appliance, the method comprising:

passing solvent-based cleaning fluid from a wash basket through a coarse filter configured to remove relatively large particulates from the cleaning fluid;

passing cleaning fluid from the coarse filter through a particulate filter configured to remove relatively line particulates from the cleaning fluid;

separating an aqueous phase that may be present in the cleaning fluid by decanting and coalescing of fluid through a separator/filter assembly;

passing the cleaning fluid through a regeneration cartridge for removing any water that may remain in the cleaning fluid, and for adsorbing organic contaminants that may be present in the cleaning fluid; and storing recovered solvent in a tank for subsequent use in a cleaning process performed by the appliance, wherein the cleaning, fluid is processed at a first flow rate selected to partially remove contaminants present therein while the appliance performs an ongoing operational cycle to be followed by a successive operational cycle, and wherein cleaning fluid is subsequently processed at a second flow rate selected to remove any remaining contaminants, wherein the first flow rate is sufficiently fast relative to f he second flow rate so that partially purified cleaning fluid may be available for any successive operational cycles of the appliance.

2. The method of claim 1 wherein the coarse filter, the particulate filter, the separator/filter assembly, and the regeneration cartridge comprise a unitary assembly.

3. The method of claim 1 wherein the coarse filter, the particulate filter, the separator/filter assembly, and the regeneration cartridge comprise individualized components.

4. The method of claim 1 wherein the cleaning fluid comprises cyclic siloxane solvent plus about 0.25% to 15% of a polar solvent.

5. The method of claim 4 wherein the polar solvent comprises water.

6. The method of claim 4 wherein the cleaning fluid further comprises approximately about 0.01% to 0.5% detergent by weight of a total fluid charge.

7. The method of claim 1 further comprising diluting partially purified cleaning fluid with purified cleaning fluid, wherein the volume of purified solvent comprises at least 50% of the volume of the partially purified cleaning fluid.

8. The method of claim 1 wherein the first flow rate comprises about 1300 ml/min, the second flow rate comprises about 660 ml/min, the tank size comprises about 38 liters, and total cycle time for processing the cleaning fluid comprises about 90 minutes.

9. The method of claim 8 wherein the single flow rate comprises about 650 ml/mm, and the cycle time for processing the fluid comprises about 100 minutes.

10. The method of claim 9 wherein the single flow rate comprises about 650 ml/min, the tank size comprises about 57 liters, and the cycle time for processing the fluid comprises about 90 minutes.

11. A method for recovering and purifying a solvent used in an article cleaning appliance, the method comprising:

passing solvent-based cleaning fluid from a wash basket through a coarse filter configured to remove relatively large particulates from the cleaning fluid;

passing cleaning fluid from the coarse filter through a particulate filter configured to remove relatively fine particulates from the cleaning fluid;

separating an aqueous phase that may be present in the cleaning fluid by decanting and coalescing of fluid through a separator/filter assembly;

passing the cleaning fluid through a regeneration cartridge for removing any water that may remain in the cleaning fluid, and for adsorbing organic contaminants that may be present in the cleaning fluid; and storing recovered solvent in a tank for subsequent use in a cleaning process performed by the appliance, wherein the method further comprises a first solvent-purifying iteration wherein cleaning fluid is passed at a first flow rate through the coarse and particulate filters for removing particulates present therein, and the method further comprises a second solvent-purifying iteration wherein cleaning fluid is subsequently passed at a second flow rate through the regeneration cartridge, wherein the first flow rate Is sufficiently fast relative to the second flow rate so that partially purified cleaning fluid from the first iteration may be available on demand for any successive operational cycle of the appliance without having to wait for completion of the second iteration.

12. The method of claim 11 further comprising diluting partially purified cleaning fluid with purified cleaning fluid, wherein the volume of purified solvent comprises at least 50% of the volume of the partially purified cleaning fluid.

13. The method of claim 12 wherein the volume of the first portion of the cleaning fluid recovered from an ongoing operational cycle comprises about 45% relative to the volume extracted from the storage tank.

14. A method for recovering and purifying a solvent used in an article cleaning appliance, the method comprising:

passing solvent-based cleaning fluid from a wash basket through a coarse filter configured to remove relatively large particulates from the cleaning fluid;

passing cleaning fluid from the coarse filter through a particulate filter configured to remove relatively fine particulates from the cleaning fluid;

separating an aqueous phase that may be present in the cleaning fluid by decanting and coalescing of fluid through a separator/filter assembly;

passing the cleaning fluid through a regeneration cartridge for removing any water that may remain in the cleaning fluid, and for adsorbing organic contaminants that may be present in the cleaning fluid; and storing recovered solvent in a tank for subsequent use in a cleaning process performed by the appliance, wherein a first portion of the solvent-based cleaning fluid used for a next operational cycle of the appliance comprises solvent recovered from an ongoing operational cycle, and a second portion of the cleaning fluid comprises purified solvent extracted from the storage tank, whereby the volume of the first portion is sufficiently high relative to the volume of the second portion to avoid use of a relatively lame storage tank, and further whereby the volume of the first portion is sufficiently low relative to the volume of the second portion to avoid a relatively high flow rate for processing the recovered solvent.

15. A method for recovering and purifying a solvent used in an article cleaning appliance, the method comprising:

passing solvent-based cleaning fluid from a wash basket through a coarse filter configured to remove relatively large particulates from the cleaning fluid;

passing cleaning fluid from the coarse filter through a particulate filter configured to remove relatively fine particulates from the cleaning fluid;

separating an aqueous phase that may be present in the cleaning fluid by decanting and coalescing of fluid through a separator/filter assembly;

passing the cleaning fluid through a regeneration cartridge for removing any water that may remain in the cleaning fluid, and for adsorbing organic contaminants that may be present in the cleaning fluid; and storing recovered solvent in a tank for subsequent use in a cleaning process performed by the appliance, wherein the cleaning fluid is processed at a single flow rate selected to remove contaminants present therein while the appliance performs an ongoing operational cycle, wherein the single flow rate comprises a relatively slower value, thereby providing a relatively longer cycle time for processing the fluid.

16. A method for recovering and purifying a solvent used in an article cleaning appliance, the method comprising:

passing solvent-based cleaning fluid from a wash basket through a coarse filter configured to remove relatively large particulates from the cleaning fluid;

passing cleaning fluid from the coarse filter through a particulate filter configured to remove relatively fine particulates from the cleaning fluid;

separating an aqueous phase that may be present in the cleaning fluid by decanting and coalescing of fluid through a separator/filter assembly;

passing the cleaning fluid through a regeneration cartridge for removing any water that may remain in the cleaning fluid, and for adsorbing organic contaminants that may be present in the cleaning fluid; and storing recovered solvent in a tank for subsequent use in a cleaning process performed by the appliance, wherein the cleaning fluid is processed at a single flow rate selected to remove contaminants present therein while the appliance performs an ongoing operational cycle, wherein the single flow rate comprises a relatively slower value, and in combination with a relatively larger tank size avoids extending a cycle time for processing the fluid.

* * * * *

UNITED STATES PATENT AND TRADEMARK OFFICE

CERTIFICATE OF CORRECTION

PATENT NO. : 7,210,182 B2
APPLICATION NO. : 10/330734
DATED : May 1, 2007
INVENTOR(S) : Fyvie et al.

It is certified that error appears in the above-identified patent and that said Letters Patent is hereby corrected as shown below:

In Column 11, Line 64, delete “mm/min)” and insert -- ml/min) --, therefor.

In Column 27, Line 44, in Claim 1, delete “line” and insert -- fine --, therefor.

In Column 27, Line 62, in Claim 1, delete “f he” and insert -- the --, therefor.

In Column 29, Line 23, in Claim 14, delete “lame” and insert -- large --, therefor.

Signed and Sealed this

Eighteenth Day of November, 2008

JON W. DUDAS
*Director of the United States Patent and Trademark Office*